US012071869B2

(12) United States Patent
Weidauer et al.

(10) Patent No.: US 12,071,869 B2
(45) Date of Patent: Aug. 27, 2024

(54) SLIDE CAM SYSTEM AND MOTOR

(71) Applicants: THYSSENKRUPP PRESTA TECCENTER AG, Eschen (LI); thyssenkrupp AG, Essen (DE)

(72) Inventors: Marcel Weidauer, Chemnitz (DE); Jens Schirmer, Chemnitz (DE)

(73) Assignees: THYSSENKRUPP PRESTA TECCENTER AG, Eschen (LI); thyssenkrupp AG, Essen (DE)

( * ) Notice: Subject to any disclaimer, the term of this patent is extended or adjusted under 35 U.S.C. 154(b) by 75 days.

(21) Appl. No.: 17/598,091

(22) PCT Filed: Mar. 24, 2020

(86) PCT No.: PCT/EP2020/058182
§ 371 (c)(1),
(2) Date: Sep. 24, 2021

(87) PCT Pub. No.: WO2020/193560
PCT Pub. Date: Oct. 1, 2020

(65) Prior Publication Data

US 2022/0186640 A1 Jun. 16, 2022

(30) Foreign Application Priority Data

Mar. 25, 2019 (DE) ..... 10 2019 107 626.9

(51) Int. Cl.
*F01L 13/00* (2006.01)
*F01L 1/047* (2006.01)
*F01L 1/46* (2006.01)

(52) U.S. Cl.
CPC ..... *F01L 13/0036* (2013.01); *F01L 1/047* (2013.01); *F01L 1/46* (2013.01); *F01L 13/0015* (2013.01);
(Continued)

(58) Field of Classification Search
CPC ..... F01L 13/0015; F01L 1/047; F01L 1/46; F01L 13/0036; F01L 2001/0473;
(Continued)

(56) References Cited

U.S. PATENT DOCUMENTS 8,707,917 B2 4/2014 Schiepp
8,960,143 B2 2/2015 Meintschel et al.
(Continued)

FOREIGN PATENT DOCUMENTS

CN 103032121 A * 4/2013 ..... F01L 1/053
CN 108661737 A 10/2018
(Continued)

OTHER PUBLICATIONS

DE-102007010149-A1, English Lnaguage Machine Translation (Year: 2008).*
(Continued)

*Primary Examiner* — Wesley G Harris
(74) *Attorney, Agent, or Firm* — thyssenkrupp North America, LLC

(57) ABSTRACT

A slide cam system includes a camshaft comprising a carrier shaft with slide cam elements that each comprise a slotted switching member having a switching groove. The slide cam elements are displaceable axially relative to the carrier shaft by an actuator pin. A displacement element is arranged parallel with a longitudinal axis of the carrier shaft, and the displacement element is axially displaceable in a direction of the longitudinal axis. The displacement element has a first coupling pin arranged in a region of the first slide cam element and a second coupling pin arranged in a region of the second slide cam element. The coupling pins cooperate with a slotted switching member of the associated slide cam element such that as a result of the displacement element a
(Continued)

movement initiated by the actuator pin of the first slide cam element can be transmitted to the second slide cam element.

40 Claims, 11 Drawing Sheets

(52) U.S. Cl.
CPC . *F01L 2001/0473* (2013.01); *F01L 2013/001* (2013.01); *F01L 2013/0052* (2013.01); *F01L 2013/0078* (2013.01); *F01L 2820/031* (2013.01)

(58) Field of Classification Search
CPC ..... F01L 2013/0052; F01L 2820/031; F01L 2820/03; F01L 2013/001; F01L 2013/101; F01L 13/0005; F01L 2013/10
See application file for complete search history.

(56) References Cited

U.S. PATENT DOCUMENTS

| | | | | |
|---|---|---|---|---|
| 9,249,697 | B2 | 2/2016 | Doller | |
| 10,260,380 | B2 | 4/2019 | Schmidt et al. | |
| 2010/0236506 | A1 | 9/2010 | Meintschel et al. | |
| 2013/0025554 | A1* | 1/2013 | Werler | F01L 13/0036 123/90.18 |
| 2018/0023424 | A1 | 1/2018 | McCarthy, Jr. et al. | |

FOREIGN PATENT DOCUMENTS

| | | | | |
|---|---|---|---|---|
| DE | 102007010157 | A1 * | 6/2008 | F01L 1/047 |
| DE | 102007010149 | A1 * | 9/2008 | F01L 1/047 |
| DE | 102007037232 | A1 | 2/2009 | |
| DE | 102007037747 | A1 | 2/2009 | |
| DE | 102007052249 | A1 | 5/2009 | |
| DE | 102008005639 | A1 | 7/2009 | |
| DE | 102008050776 | A1 | 4/2010 | |
| DE | 102008054254 | A1 | 5/2010 | |
| DE | 102008060166 | A1 | 6/2010 | |
| DE | 102010004591 | A1 | 7/2011 | |
| DE | 102010021903 | A1 * | 12/2011 | F01L 13/0036 |
| DE | 102011011456 | A1 * | 8/2012 | F01L 1/34 |
| DE | 102011001123 | A1 | 9/2012 | |
| DE | 102011002141 | A1 * | 10/2012 | F01L 1/047 |
| DE | 102011078434 | A1 | 1/2013 | |
| DE | 102011080267 | A1 | 2/2013 | |
| DE | 102011053333 | A1 | 3/2013 | |
| DE | 102011054218 | A1 * | 4/2013 | F01L 1/053 |
| DE | 102011116653 | A1 | 4/2013 | |
| DE | 102011085702 | A1 | 5/2013 | |
| DE | 102012022123 | A1 | 5/2013 | |
| DE | 102011121684 | A1 | 6/2013 | |
| DE | 102012022208 | A1 | 6/2013 | |
| DE | 102012004911 | A1 | 9/2013 | |
| DE | 102012008555 | B4 | 10/2013 | |
| DE | 102012217300 | A1 | 3/2014 | |
| DE | 102012112038 | A1 | 6/2014 | |
| DE | 102012112795 | A1 | 6/2014 | |
| DE | 102013009757 | A1 | 12/2014 | |
| DE | 102013111410 | A1 | 4/2015 | |
| DE | 102013113348 | A1 | 6/2015 | |
| DE | 102013113349 | A1 | 6/2015 | |
| DE | 102014007189 | A1 | 11/2015 | |
| DE | 102014216058 | A1 | 2/2016 | |
| DE | 102015220602 | A1 | 4/2017 | |
| DE | 102016204892 | A1 | 9/2017 | |
| DE | 102016005454 | A1 | 11/2017 | |
| DE | 10 2017 221 870 | A1 | 11/2018 | |
| DE | 102018111942 | A1 | 11/2019 | |
| DE | 102018112414 | A1 | 11/2019 | |
| DE | 102018112415 | A1 | 11/2019 | |
| DE | 102018112416 | A1 | 11/2019 | |
| DE | 102018112417 | A1 | 11/2019 | |
| DE | 102018112419 | A1 | 11/2019 | |
| DE | 102019102103 | A1 | 11/2019 | |
| EP | 2132418 | B1 | 12/2009 | |
| EP | 2181251 | B1 | 5/2010 | |
| EP | 2331795 | B1 | 6/2011 | |
| EP | 2473716 | B1 | 7/2012 | |
| EP | 2487341 | A1 | 8/2012 | |
| EP | 2585687 | B1 | 5/2013 | |
| EP | 2676015 | B1 | 12/2013 | |
| EP | 2823159 | B1 | 1/2015 | |
| EP | 2859199 | B1 | 4/2015 | |
| EP | 3365537 | B1 | 8/2018 | |
| JP | 2012-505 333 | A | 3/2012 | |
| JP | 2013253485 | A * | 12/2013 | |
| WO | 2016177479 | A1 | 11/2016 | |
| WO | 2017/067549 | A1 | 4/2017 | |
| WO | 2017/079383 | A1 | 5/2017 | |
| WO | WO-2017081379 | A1 * | 5/2017 | F01L 1/047 |
| WO | 2018195370 | A1 | 10/2018 | |

OTHER PUBLICATIONS

DE-102010021903-A1, English Lnaguage Machine Translation (Year: 211).*
DE-102011054218-A1, English Lnaguage Machine Translation (Year: 2013).*
JP-2013253485-A, English Lnaguage Machine Translation (Year: 2013).*
English Translation of International Search Report Issued in PCT/EP2020/058182 dated Jun. 22, 2020.

* cited by examiner

SLIDE CAM SYSTEM AND MOTOR

CROSS REFERENCE TO RELATED APPLICATIONS

This application is a U.S. National Stage Entry of International Patent Application Serial Number PCT/EP2020/058182, filed Mar. 24, 2020, which claims priority to German Patent Application No. DE 10 2019 107 626.9, filed Mar. 25, 2019, the entire contents of both of which are incorporated herein by reference.

FIELD

The present disclosure generally relates to camshafts, including slide cam systems and motors with such slide cam systems.

BACKGROUND

A slide cam system is known, for example, from DE 10 2011 5 054 218 A1.

In the known slide cam system, a rotatably supported camshaft is provided. The camshaft comprise a plurality of slide cams. The slide cams are axially movable. The axial movement of the slide cams is initiated by an actuator.

For this purpose, a coupling rod is securely connected via a switching fork to a slide cam which is axially moved directly by the actuator. During an axial movement of the slide cam, the coupling rod is moved with the slide cam.

The coupling rod comprises slotted members. The slotted members are securely connected to the coupling rod. The slotted members are each associated with an additional slide cam. The additional slide cams have pins which cooperate with the associated slotted members in such a manner that the additional slide cams are displaced in accordance with the movement of the slide cam which is securely connected to the coupling rod.

The slide cam system described above has the following disadvantages.

During the construction and production of motors, it is necessary for the structural space available to be used efficiently. The coupling rod having slotted members requires a large amount of space as a result of the construction. Furthermore, the production and cost expenditure which such a coupling rod causes is comparatively high.

Thus a need exists for a slide cam system by which structural space can be saved and which can be achieved with a low production and cost expenditure. Further, a need also exists for a motor having such a slide cam system.

DETAILED DESCRIPTION

Figure 1:
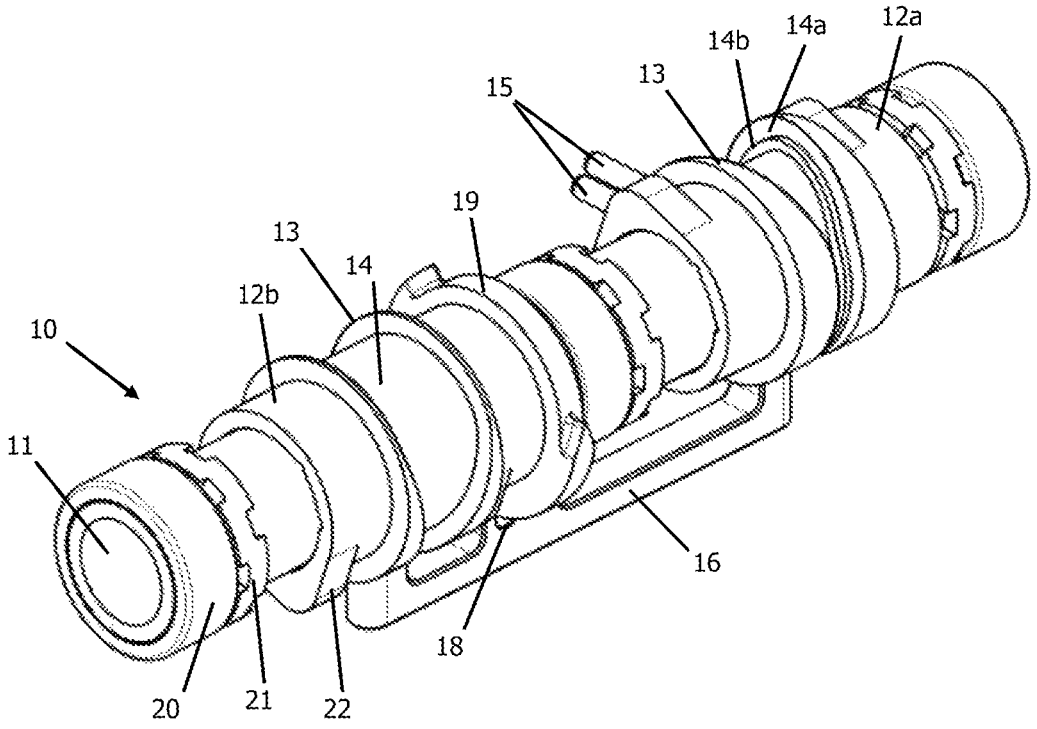
FIG. 1 is a perspective view of an example slide cam system.
Figure 2:
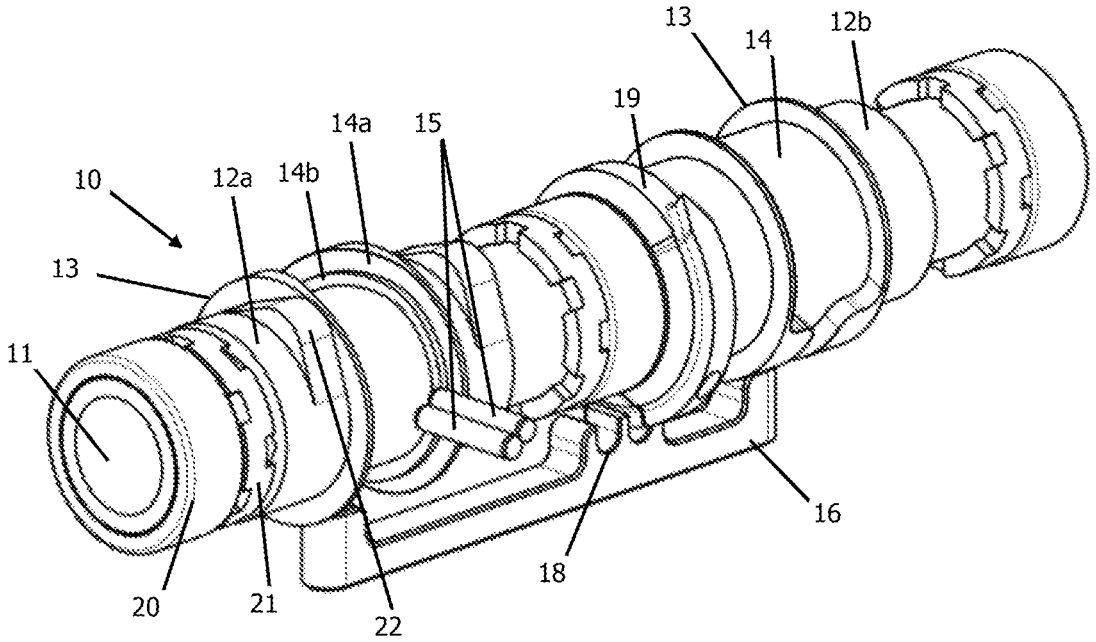
FIG. 2 is another perspective view of the example slide cam system of FIG. 1.
Figure 3:
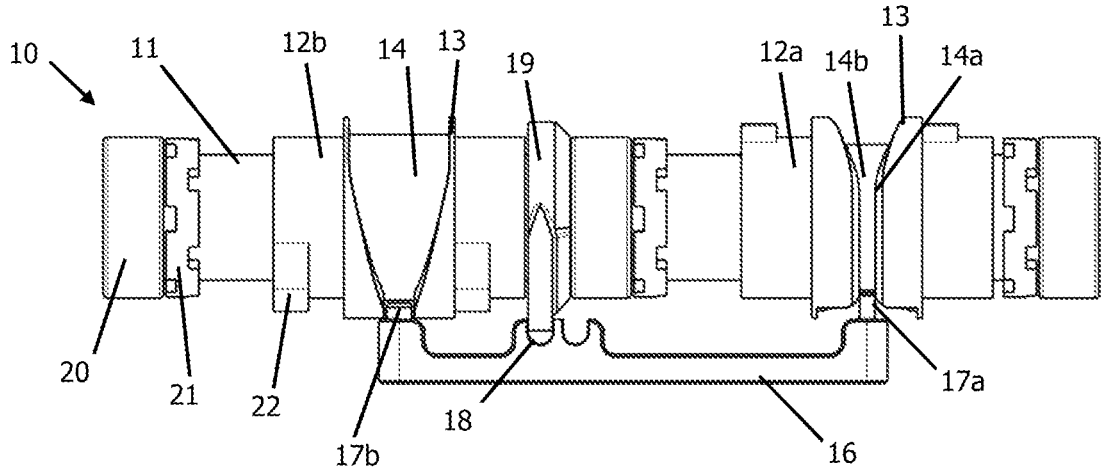
FIG. 3 is a side view of the slide cam system of FIGS. 1 and 2.
Figure 4:
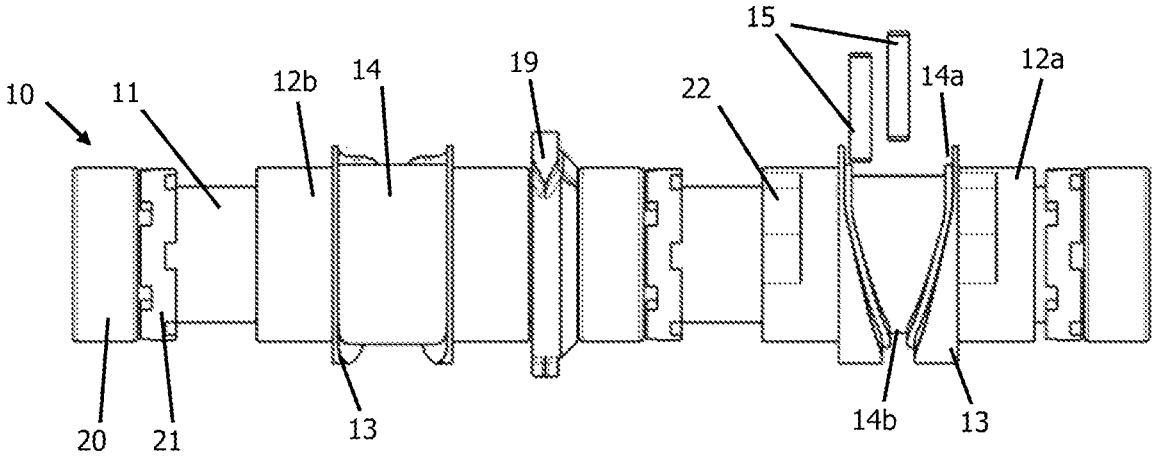
FIG. 4 is another side view of the example slide cam system of FIGS. 1-3.

Although certain example methods and apparatuses have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

In some examples, a slide cam system for an internal combustion engine may have at least one camshaft comprising a carrier shaft having at least two slide cam elements. The slide cam elements each comprise a slotted switching member having at least one switching groove, wherein the slide cam elements are displaceable axially relative to the carrier shaft by at least one actuator pin. At least one displacement element is arranged parallel with a longitudinal axis of the carrier shaft, wherein the displacement element is axially displaceable in the direction of the longitudinal axis of the carrier shaft. In other words, the displacement element is axially displaceable along the longitudinal axis of the carrier shaft. The displacement element has at least two coupling pins, wherein a first coupling pin is arranged in the region of the first slide cam element and a second coupling pin is arranged in the region of the second slide cam element. The coupling pins cooperate with a slotted switching member of the associated slide cam element in such a manner that, as a result of the displacement element, a movement initiated by the actuator pin of the first slide cam element can be transmitted to the second slide cam element.

The slide cam system according to the invention allows the transmission of an axial movement of a conventionally switched slide cam element to at least one other slide cam element.

The term "conventionally switched" is intended to be understood to mean that the axial movement is initiated by an actuator, in particular by an actuator pin.

In order to move the first slide cam element in an axial direction, the actuator pin engages in a first switching groove of the slotted switching member of the first slide cam element. The actuator pin is not movable in the axial direction of the carrier shaft. The actuator pin is partially guided in the switching groove and delimited by at least one flank of the switching groove. As a result of the path of the switching groove, the sliding cam element is displaceable in an axial direction. The actuator pin is arranged in the switching groove only during the displacement operation.

The first coupling pin engages in a second switching groove. The first coupling pin is permanently arranged in the second switching groove. During displacement of the first slide cam element, the first coupling pin cooperates with the second switching groove in such a manner that the axial movement of the slide cam element is transmitted to the displacement element.

In a possible embodiment, the transmission of the movement is carried out by the angular offset of the actuator pin relative to the displacement element in a temporally offset manner. In another possible embodiment, the first slide cam element comprises an annular groove, in which the first coupling pin permanently engages and thus allows a temporally simultaneous displacement of the displacement element.

The second coupling pin is arranged on the displacement element in a manner offset from the first coupling pin in an axial direction of the carrier shaft. The second coupling pin cooperates with a second slide cam element. More specifically, the second coupling pin engages in a switching groove of the slotted switching member of the second slide cam element. As a result of the axial movement of the displacement element, the second coupling pin is arranged on a flank of the switching groove of the second slide cam element. The second coupling pin acts on the flank of the switching groove of the second slide cam element with a force which axially moves the second slide cam element in accordance with the movement of the first slide cam element. It is conceivable for the displacement element to comprise a plurality of coupling pins which cooperate with additional slide cam elements.

The advantage of the slide cam system according to the invention is that the displacement element has a simple and space-saving construction. Since the coupling pins of the displacement element engage in the slotted members of the slide cam elements, the displacement element can be arranged nearer the carrier shaft, whereby less structural space is taken up by the camshaft.

Preferred embodiments of the invention are set out in the dependent claims.

The displacement element is arranged parallel with a longitudinal axis of the carrier shaft. A movement in an axial direction of the carrier shaft can thereby be carried out in a simple manner. It is conceivable for the displacement element to be arranged on a rail For this purpose.

In a particularly preferred embodiment, the displacement element comprises at least one receiving element and the carrier shaft comprises at least one locking element which cooperate with each other during operation in such a manner that the displacement element is locked between two positional changes. The advantage is that the displacement element is locked and the slide cam element does not carry out any undesirable movements, for example, triggered as a result of impacts or vibrations.

In another embodiment, the locking element forms an abutment for the receiving element so that the locking element is acted on at least partially with the forces which act during the positional change of the at least second slide cam element.

For this purpose, for example, a circular disk is arranged on the carrier shaft and extensions are arranged on the displacement element. The circular disk is arranged between the extensions during operation. The extensions delimit the circular disk in an axial direction. The circular disk forms an abutment for the extensions of the displacement element. In other words, the displacement element is supported with an extension against the circular disk. The circular disk thus takes up the switching forces of the second slide cam element. The circular disk comprises a recess, which is constructed at a rotation angle of the circular disk in such a manner that, during an axial positional change of the displacement element, the circular disk does not collide with any extension.

Advantageously, the displacement element comprises a spring/ball locking system. The displacement element is thereby further axially secured. Thus, an axial movement of the displacement element in the region of the recess of the circular disk is possible only when the axial movement is initiated by the first slide cam element.

In a preferred embodiment, the at least one actuator pin and the at least two coupling pins are offset in a peripheral direction of the carrier shaft, in particular offset in a peripheral direction of the carrier shaft through 90°. More specifically, the actuator pin and the coupling pin are offset from each other in a peripheral direction. An offset switching of the slide cam elements is thereby possible. Alternatively, other angular offsets, for example, greater than 90° or less than 90°, are conceivable.

In a particularly preferable manner, the slotted switching member of the first slide cam element comprises a first switching groove and at least a second switching groove, wherein the first switching groove is provided for receiving the at least one actuator pin and the second switching groove is provided for receiving the first coupling pin.

As a result of the mutually separate switching grooves, a phase-shifted movement of the displacement element or the slide cam elements is advantageously possible.

In a further particularly preferable manner, the first switching groove and the second switching groove have the same rotation angle, wherein the radius of the first switching groove is greater than the radius of the second switching groove. An offset switching of the slide cam elements is thereby possible. Alternatively, other degrees of offset are conceivable.

It is advantageous for the first and second switching grooves of the first slide cam element to have at least partially a V-shaped profile. By changing the groove width in an axial direction of the carrier shaft, a stepless displacement of the slide cam element can be achieved. Other shapes, for example, S-shaped, are conceivable.

Particularly advantageously, the first switching groove of the first slide cam element has at least partially a Y-shaped profile. It is thereby possible for the first slide cam element to comprise a second switching groove for the first coupling pin which is arranged in such a manner that the second slide cam can be displaced directly.

Particularly preferably, the second switching groove for the first coupling pin is at least partially arranged centrally in the Y-shaped first switching groove. A direct displacement of the second slide cam element is thereby possible.

In a more advantageous manner, the second switching groove is constructed as a groove which extends over the periphery with a constant radius and in which the first coupling pin is permanently arranged in such a manner that an axial displacement of the first slide cam element can be transmitted directly to the displacement element. More specifically, it is thus possible for a temporally offset or phase-shifted axial movement of the at least second slide cam element to be dependent only on the slotted switching member of the at least second slide cam element.

In another preferred embodiment, the first switching groove of the first slide cam element has regions with different radii which are each associated with a region of the first slide cam element, in particular an introduction region, a displacement region and a discharge region. This results in a soft introduction and discharge of the actuator pin and a substantially stepless displacement of the first slide cam element.

It is advantageous for the slotted switching member of the second slide cam element to have at least partially a V-shaped profile. The V-shaped profile can readily be achieved, for example, by milling.

Advantageously, the carrier shaft comprises at least a third, in particular at least a fourth, slide cam element. The slide cam system can thereby be used in relatively large internal combustion engines. It is conceivable for the slide cam system to comprise a plurality of camshafts.

In a preferred embodiment, the slide cam elements are constructed as double slide cam elements, wherein each of the double slide cam elements is constructed to control valves of two cylinders.

Valve cams, in particular cam portions having one or more cam contours, from a single cylinder and valve cams, in particular cam portions having one or more cam contours, from a plurality of adjacent cylinders can be arranged on the respective slide cam elements. The valve cams of the respective slide cam element may have different valve strokes.

For example, double slide cam elements which comprise valve cams from two adjacent cylinders can be used. In other words, the double slide cam elements can be constructed to actuate valves from two adjacent, in particular separate, cylinders. In this instance, the camshaft may have precisely two double slide cam elements, wherein each double slide cam element controls at least one valve from two adjacent cylinders during operation. Such camshafts can be used in four-cylinder variants of internal combustion engines.

Alternatively, the slide cam elements can be constructed to control at least one valve from a single cylinder. In this case, the camshaft may have precisely three slide cam elements. Such camshafts can be used in three-cylinder variants of internal combustion engines.

Generally, both valve cams for associated inlet valves and/or associated outlet valves can be arranged on the respective slide cam elements or double slide cam elements or only on one of the slide cam elements or double slide cam elements. The combination of valve cams for associated inlet valves and associated outlet valves on the slide cam element(s) or double slide cam element(s) can be used for internal combustion engines with only one camshaft. This camshaft can be used, for example, as a single overhead camshaft (SOHC) in internal combustion engines.

In a preferred embodiment, the switching grooves of the first and second slide cam elements are arranged in a manner offset relative to each other at a rotation angle so that the second slide cam element can be displaced in a longitudinal direction of the carrier shaft in a temporally offset manner relative to the first slide cam element.

The temporally offset displacement of the slide cam element allows a temporally offset activation and/or deactivation of the valves of a cylinder of an internal combustion engine.

In another embodiment, the second and the third slide cam elements each have at least partially a V-shaped profile, wherein the V-shaped profiles each have a constant radius.

The V-shaped profiles with a constant radius are advantageous because no introduction path or discharge path is necessary in the second and third slide cam elements.

In a particularly preferable manner, the switching grooves of the first, second and third slide cam elements are arranged so as to be offset relative to each other at a rotation angle in such a manner that the second and third slide cam elements can each be displaced in a temporally offset manner relative to the first slide cam element in a longitudinal direction of the carrier shaft.

A temporally offset activation and/or deactivation of the valves of a cylinder, in particular a plurality of cylinders, is thereby possible.

In a preferred embodiment, the slide cam elements each have at least one cam portion for controlling a valve of a cylinder, wherein at least one stroke cam contour is constructed in the cam portion in order to actuate the valve. Preferably, the slide cam elements each have at least two cam portions for controlling valves of only one cylinder, wherein at least one stroke cam contour is constructed in the cam portions in order to actuate the respective valve. In other words, the slide cam elements can each switch valves of only one cylinder. The cam portions of the slide cam elements are therefore associated with only one cylinder.

In this instance, a configuration of the slide cam elements in a plurality of different variants is advantageously enabled. For example, the cam portion may have a plurality of cam contours preferably with different strokes so that actuation of the associated valve is possible in a plurality of switching steps, that is to say, with different strokes.

In a preferred embodiment, the slide cam elements, in particular double slide cam elements, each have at least two cam portions for controlling valves of two adjacent cylinders.

At least one stroke cam contour is constructed in the two cam portions in order to actuate the valve of one of the two adjacent cylinders. Preferably, the slide cam elements, in particular double slide cam elements, each have at least four cam portions for controlling valves from two adjacent cylinders, wherein in the cam portions at least one stroke cam contour is constructed in order to actuate the respective valve. In other words, the slide cam elements, in particular double slide cam elements, each switch valves of two cylinders. The cam portions of the slide cam elements, in particular double slide cam elements, are each associated with two cylinders in this case.

Advantageously in this case, double slide cam elements with more than one cam portion which may have a plurality of cam contours preferably with different strokes are enabled. An actuation of the associated valves in a plurality of switching steps is thereby possible, that is to say, with different strokes.

Generally, the respective cam portion is used to control an associated valve of a cylinder. In other words, the associated valve can be actuated by the cam portion, that is to say, a stroke is transmitted thereto, or the associated valve may not be actuated and consequently the cylinder may be switched off.

Preferably, the respective cam portion has at least two stroke cam contours, in particular at least three stroke cam contours, for actuating the valve, wherein the stroke cam contours each comprise different strokes. The associated valve can thereby be operated in two switching steps. In other words, the associated valve can be actuated with two different strokes during axial displacement of the slide cam element. In another variant, the respective cam portion may have at least three stroke cam contours with different strokes. The associated valve can thereby be operated in a total of three switching steps. During the axial displacement of the slide cam element, consequently, the associated valve can be acted on with three different strokes. The described multi-step control of a valve of a cylinder allows increased variability during the control of the valve and consequently of the internal combustion engine. For example, the change between different operating modes of the internal combustion engine can thereby be carried out, for example, full-load operation, partial load operation.

More preferably, the cam portion additionally has at least one zero stroke cam contour for switching off the cylinder associated with the valve, wherein the zero stroke cam contour adjoins a/the stroke cam contour. The cam portion may have a stroke cam contour and an adjacent zero stroke cam contour. During the axial displacement of the slide cam element, switching can be carried out in this case between the stroke cam contour or the zero stroke cam contour. This corresponds to a two-step control of the valve. Alternatively, the cam portion may have two stroke cam contours with different strokes and an adjacent zero stroke cam contour. During the axial displacement of the slide cam element, switching can be carried out in this case between the two stroke cam contours or between one of the two stroke contours and the zero stroke cam contour. This corresponds to a three-step control of the valve. Additional combinations of a plurality of stroke cam contours and at least one zero stroke cam contour are possible.

In the context of the invention, the stroke cam contour corresponds to a contour which brings about a stroke of the associated valve during operation. The stroke cam contour is part of a stroke cam. The zero stroke cam contour does not bring about any stroke of the associated valve. The zero stroke cam contour is part of a zero stroke cam. The zero stroke cam contour is preferably constructed in a circular, in particular cylindrical, manner. The zero stroke cam contour is advantageously used for switching off cylinders.

In an embodiment, there is provided at least one multiple actuator which has at least two actuator pins, in particular at least three actuator pins, and by means of which the slide cam elements can be moved into at least two, in particular three, axial positions in order to allow different switching positions, in particular for two-step, three-step or multiple-step control, for the valves. As a result of the two actuator pins of the multiple actuator, the slide cam elements which are coupled to each other by the displacement element can be displaced between a total of two axial positions. In this configuration, the at least one cam portion of the respective slide cam element preferably has a stroke cam contour and a zero stroke cam contour or two stroke cam contours with different strokes. As a result of the combination of the multiple actuator with two actuator pins and the cam portion with two contours, a two-step control of the valve associated with the cam portion is enabled.

In a variant with three actuator pins of the multiple actuator, the slide cam elements which are coupled to each other by the displacement element can be displaced between a total of three axial positions. In this configuration, the at least one cam portion of the respective slide cam element preferably has two stroke cam contours with different strokes and one zero stroke cam contour or a total of three stroke cam contours with different strokes. As a result of the combination of the multiple actuator with three actuator pins and the cam portion with a total of three contours, a three-step control of the valve associated with the cam portion is enabled.

In another embodiment, the first slide cam element and the multiple actuator are arranged in a first axial region of the carrier shaft and the second and/or third slide cam element(s) is/are arranged in a second axial region of the carrier shaft adjoining the first axial region. In another embodiment, the first slide cam element and the multiple actuator are arranged in a longitudinal direction of the carrier shaft between the second and third slide cam elements, in particular centrally, and the second and/or third slide cam element(s) is/are arranged in a second axial region of the carrier shaft adjoining the first axial region. By differently arranging the slide cam elements and the multiple actuator, the slide cam system is adaptable in a variable manner to the present structural space situation and the tolerance position.

In another preferred embodiment, the locking element has at least partially a circular disk or an annular disk, wherein the locking element is arranged between the first and second slide cam elements or between the second and third slide cam elements. Alternatively, the locking element can be arranged between an axle end of the carrier shaft and one of the slide cam elements. The axle end is the longitudinal end of the carrier shaft in this instance. In the configuration of the camshaft with two double slide cam elements, the locking element can be arranged between the two double cam elements or be arranged between an axle end or longitudinal end of the carrier shaft and one of the double cam elements. A configuration of the camshaft with more than two double slide cam elements is possible.

The circular disk or the annular disk are advantageous because they each have a planar face which is suitable as an abutment in an axial direction of the carrier shaft.

In another preferred embodiment, the locking element is constructed integrally with the carrier shaft. Preferably, the locking element is formed by at least one recess in the carrier shaft. The recess can be formed by at least two peripheral grooves and at least one longitudinal passage which connects the grooves. The grooves can be constructed so as to extend radially in the carrier shaft. During operation, the receiving element is at least partially arranged in one of the two grooves in a manner dependent on the axial position of the slide cam elements. If, during operation, in a displacement operation the axial position of the slide cam elements and consequently of the displacement element is changed, the receiving element travels through the longitudinal passage and changes from the first peripheral groove to the second peripheral groove. In this case, the receiving element is supported against the groove walls in order to transmit forces which occur during the axial displacement to the carrier shaft. This configuration of the recess is used in a two-step control of the valves, in particular by two contours of the respective cam portions.

In a three-step control of the valves, in particular by three contours of the respective cam portions, the recess can be formed by a total of three peripheral grooves and two longitudinal passages. In this case, one longitudinal passage connects two grooves so that, during axial displacement of the slide cam elements, a total of three axial positions are possible. The force transmission from the receiving element to the carrier shaft can be brought about as described above.

In the context of the invention, the receiving element is suitable for receiving the locking element, in particular the circular disk or the annular disk, and for being received by the locking element, in particular the recess of the carrier shaft.

The integral embodiment of the locking element has the advantage that a locking element as a separate component can be dispensed with. The locking element is replaced in this instance by the recess in the carrier shaft. The construction of the slide cam system is thereby simplified and costs are saved.

In another embodiment, at least one camshaft bearing, in particular roller bearing and/or sliding bearing, is provided. In this case, a portion of the camshaft bearing forms the locking element. This embodiment also has the advantage that components are reduced and consequently costs are saved.

In a preferred embodiment, the carrier shaft has at least two locking elements. Furthermore, the receiving element of the displacement element preferably forms at least one extension which cooperates during operation with one or both locking elements so that at least one of the two locking elements can be at least partially acted on with the forces which act during a positional change of the second and/or third slide cam element(s). The locking element may be arranged on one of the two locking elements during operation in a manner dependent on the axial position of the slide cam elements or be arranged between the two locking elements. The locking elements delimit the extension in an axial direction. The locking elements each form an abutment for the extension of the displacement element. During operation, the displacement element is supported with the extension against one of the two locking elements. The locking element thus receives the switching forces of the second or third slide cam element. The locking element comprises a recess which is constructed at a rotation angle of the locking element in such a manner that, during an axial positional change of the displacement element, the locking element does not collide with the extension.

In another preferred embodiment, the carrier shaft has at least one locking element. Furthermore, the receiving element of the displacement element preferably forms at least two extensions which cooperate during operation with the locking element so that the locking element can at least partially be acted on with the forces which act during a positional change of the second and/or third slide cam element(s). The locking element may be arranged on one of the two extensions during operation in a manner dependent on the axial position of the slide cam elements or be arranged between the two extensions. The extensions delimit the locking element in an axial direction. The locking element forms an abutment for the extensions of the displacement element. In other words, the displacement element is supported with one of the two extensions or both extensions against the locking element. The locking element thus receives the switching forces of the second or third slide cam element. The locking element comprises a recess which is constructed at a rotation angle of the locking element in such a manner that, during an axial positional change of the displacement element, the locking element does not collide with any extension.

As a result of the different combinations of extensions and locking elements of the two above-mentioned embodiments, the absorption of occurring displacement forces for a three-step control of valves can be brought about. In this case, the displacement forces are transmitted at all three axial positions from the respective receiving element to the respective locking element and consequently the loads of the system are relieved.

In another particularly preferred embodiment, a stop is constructed in a cylinder head, in particular in a cylinder cover, and the displacement element has a stop element which cooperates with the stop in the cylinder head in such a manner that the axial displacement of the displacement element is limited.

The start point and the end point of the axial displacement of the displacement element are thereby defined. Furthermore, the stop and the stop element prevent undesirable movements of the displacement element.

In a preferred embodiment, the receiving element is the stop element, wherein during operation the receiving element limits the axial displacement of the displacement element together with the stop of the cylinder head. In this case, the stop element and receiving element form a single element. The number of components and the complexity during production are thereby reduced. Consequently, costs are saved.

In another preferred embodiment, the displacement element has in a displacement direction at least one stop end which cooperates during operation with a counter-piece, in particular the cylinder head, in such a manner that the axial displacement of the displacement element is limited. The stop end can be formed by a longitudinal end of the displacement element. The displacement element preferably has two longitudinal ends and consequently two stop ends which delimit a displacement path along the longitudinal axis of the carrier shaft. For this purpose, the longitudinal ends can cooperate with stop regions of the cylinder head cover.

This also has the advantage that the start point and the end point of the axial displacement of the displacement element are fixed. Furthermore, components are thereby reduced since, instead of a separate stop element, the longitudinal ends of the displacement element delimit the axial displacement path.

It is advantageous for the locking element to be arranged in a rotationally secure manner on the carrier shaft and to be displaceable in a longitudinal direction of the carrier shaft, wherein the locking element is axially guided in the cylinder head, in particular in the cylinder head cover.

By guiding or supporting the locking element in the cylinder head, it is possible for all the axial positions to be predetermined by the cylinder head. That is advantageous for fixing the production tolerances.

The bearing may be constructed in one piece or in two pieces with the cylinder head. As a result of a one-piece construction with the cylinder head, a cost-effective and simple production is possible. Furthermore, structural space and weight can thus be saved.

The two-piece construction allows the use of different higher-strength materials. Thus, the absorption of greater forces and a reduction of the wear are possible. Furthermore, the bearing can be replaced where necessary. Furthermore, the influence of different thermal expansions in different materials can be kept small. For example, the cylinder cover may be produced from aluminum and the carrier shaft may be produced from steel. The play in the slotted switching members, the cam widths and consequently the displacement paths can thereby be kept small. Overall, the dynamic switching forces which occur in the camshaft can be better controlled.

In another embodiment, the locking element is arranged on the carrier shaft in a rotationally secure manner and is fixed in the longitudinal direction of the carrier shaft.

The locking element which is arranged on the carrier shaft in a rotationally secure manner and which is fixed in the longitudinal direction is advantageous with regard to the production tolerances since almost all the axial positions are predetermined by the camshaft. Furthermore, the thermal expansion thereby has an influence only on the groove width of the primary cam. The play in the slotted switching members, the groove widths and consequently the displacement paths can be kept small, whereby the dynamic switching forces can be better controlled.

If the locking element is arranged on the carrier shaft in a rotationally secure manner and in a manner fixed in a longitudinal direction, the spring/ball locking system of the displacement element can preferably perform the function of the stop.

The stop in the cylinder head and the stop element can thereby be dispensed with.

More preferably, the displacement element is arranged at a rotation angle so as to be offset relative to the at least one actuator pin.

It is particularly advantageous for the second switching groove to be arranged at an axial end of the first slide cam element beside the first switching groove or for the second switching groove to be arranged between two axial ends of the first sliding cam element, wherein the second switching groove extends substantially over the entire periphery of the first slide cam element.

The arrangement of the displacement element, offset by a rotation angle, and the above-described arrangement of the second switching groove on the first slide cam element are advantageous because the displacement element thus does not impede the actuator pin, and vice versa.

In an embodiment, the first switching groove of the first slide cam element is at least partially Y-shaped or at least partially S-shaped.

According to the independent claim 40, the invention relates to a slide cam system for an internal combustion engine having at least one camshaft comprising a carrier shaft having at least two double slide cam elements which are each constructed to control valves of two cylinders, wherein the double slide cam elements each comprise a slotted switching member having at least one switching groove and at least one cam portion having at least one stroke cam contour. The double slide cam elements are displaceable by at least one actuator pin axially relative to the carrier shaft. Furthermore, at least one displacement element is arranged parallel with a longitudinal axis of the carrier shaft and is axially displaceable in the direction of the longitudinal axis of the carrier shaft. The displacement element has at least two coupling pins, wherein a first coupling pin 17*a*' is arranged in the region of the first double slide cam element and a second coupling pin is arranged in the region of the second double slide cam element. The coupling pins each cooperate with a slotted switching member of the associated double slide cam element in such a manner that a movement of the first double slide cam element, initiated by the actuator pin, can be transmitted to the second double slide cam element by the displacement element.

In this instance, reference may be made to the advantages explained in connection with the slide cam system according to claim 1. Furthermore, the slide cam system according to claim 40 can, alternatively or additionally, have individual features or a combination of several of the features mentioned above in relation to the slide cam system according to claim 1.

In the context of the invention, a motor having at least one such slide cam system is further disclosed and claimed. It is possible for the motor to have a plurality of, in particular at least two, slide cam systems according to the invention. In particular, the motor may have six cylinders in a series arrangement. In this case, two of the above-mentioned slide cam systems can be used. The two slide cam systems of the six cylinder motor can in this case have a common carrier shaft, on which the slide cam elements of the two slide cam systems are arranged in an axially displaceable manner. In this case, at least two actuators, in particular multiple actuators, are preferably used for the axial displacement of the slide cam elements, wherein one actuator preferably axially displaces the slide cam elements of one of the two slide cam systems during operation.

FIGS. 1 to 4 show the same embodiment of a slide cam system from different perspectives.

The slide cam system comprises a carrier shaft 11. A first and a second slide cam element 12*a*, 12*b* are arranged on the carrier shaft 11 in an axially movable manner relative to a longitudinal axis of the carrier shaft 11. It is conceivable for more than two slide cam elements to be arranged on the carrier shaft 11. The carrier shaft 11 comprises three roller bearings 20. One roller bearing 20 is arranged at the axial ends of the carrier shaft 11 and another roller bearing 20 is arranged between the slide cam elements 12*a*, 12*b*, respectively. The roller bearings 20 are locked by retention rings 21. The number of roller bearings 20 and retention rings 21 and the positions of the bearing locations are variable. The slide cam elements 12*a*, 12*b* comprise a slotted switching member 13 and a cam contour 22.

The slotted switching member 13 of the first slide cam element 12*a* comprises a first and a second switching groove 14*a*, 14*b*. The switching grooves 14*a*, 14*b* are at least partially V-shaped. In other words, the width of the two switching grooves 14*a*, 14*b* is not constant. The term "width" is intended to be understood to mean the spacing of the flanks of the switching grooves 14*a*, 14*b* in an axial direction relative to the carrier shaft 11. The flanks of the switching grooves 14*a*, 14*b* approach each other in the V-shaped portion.

The two switching grooves 14*a*, 14*b* are arranged at the same rotation angle. The first switching groove 14*a* has a greater radius than the second switching groove 14*b*.

The term "radius" is intended to be understood to mean the amount of spacing of the base groove face of the first or second switching groove 14*a*, 14*b* from the longitudinal center axis of the carrier shaft 11. Consequently, the outer diameter of the slotted switching member 13 and the radius of the base groove face determine the groove depth.

The first switching groove 14*a* comprises a step. In other words, the first switching groove 14*a* is constructed as a projection or a shoulder. The first switching groove 14*a* has a varying radius. That is to say, the first switching groove 14*a* partially has regions with a larger radius and a smaller radius. The change of the radius is carried out steplessly. The regions are each associated with an introduction region, a discharge region or a displacement region.

The second switching groove 14*b* has a constant radius. The width of the second switching groove 14*b* is smaller than the width of the first switching groove 14*a*.

Two actuator pins 15 are arranged on the carrier shaft 11. The actuator pins 15 are movable substantially only in one direction orthogonally to the longitudinal center axis of the carrier shaft 11. The actuator pins 15 are associated with the first switching groove 14*a*. That is to say, the actuator pins cooperate only with the first switching groove 14*a*. The actuator pins 15 are spaced apart from each other in the axial direction of the carrier shaft 11. One of the two actuator pins 15 can thereby be introduced into the first switching groove 14*a* in a manner dependent on the position of the first slide cam element. By introducing the actuator pins 15, an axial movement of the first slide cam element 14*a* can be initiated.

For this purpose, an actuator pin 15 is introduced into the first switching groove 14*a*. By reducing the groove width, the introduced actuator pin 15 cooperates with a flank of the first switching groove 14*a*. More specifically, the introduced actuator pin 15 acts on a flank of the first switching groove 14*a* with a force directed counter to the flank. The axial displacement of the first slide cam element 12*a* is thereby carried out. The direction of the displacement is consequently dependent on the flank with which the introduced actuator pin 15 cooperates. An actuator pin 15 is associated with each flank of the first switching groove 14*a*.

A displacement element 16 is arranged parallel with the carrier shaft 11. The displacement element 16 is axially movable. The displacement element is offset by 90° relative to the actuator pins 15. Alternatively, other angular offsets are conceivable. The displacement element 16 comprises a first and a second coupling pin 17*a*, 17*b* and a receiving element 18. The first and second coupling pin 17*a*, 17*b* are each arranged at an axial end of the displacement element 16. The receiving element 18 comprises three extensions and is arranged between the axial ends of the displacement element 16. The coupling pins 17*a*, 17*b* and the receiving element 18 extend orthogonally to the longitudinal center axis of the carrier shaft 11.

The first coupling pin 17*a* is associated with the second switching groove 14*b* of the first slide cam element 12*a*. The first and second coupling pins 17*a*, 17*b* are arranged substantially rotatably on the displacement element 16. The first coupling pin 17*a* is permanently in engagement with the second switching groove 14*b* of the first slide cam element 12*a*.

The first coupling pin 17*a* is acted on by a flank of the second switching groove 14*b* with a force. The displacement element 16 is displaced in an active direction of the force. Since the displacement element 16 and consequently the coupling pins 17*a*, 17*b* are offset from each other by 90° in a peripheral direction and the first and second switching grooves 14*a*, 14*b* are arranged at the same rotation angle, the displacement of the displacement element 16 is accordingly carried out in a temporally offset or phase-shifted manner.

The second coupling pin 17*b* is arranged in the region of the second slide cam element 12*b*. The second slide cam element 12*b* comprises a switching groove 14. The switching groove 14 has a V-shaped portion. The second coupling pin 17*b* is permanently in engagement with the switching groove 14. The switching groove 14 of the second slide cam element 12*b* is arranged in such a manner that a switching of the second slide cam element 12*b* in a temporally offset manner relative to the first slide cam element 12*a* can be carried out.

As a result of the displacement of the displacement element 16, the second coupling pin 17*b* is axially moved in the switching groove 14. More specifically, the second coupling pin 17*b* is moved relative to one of the flanks of the switching groove 14. The second coupling pin 17*b* cooperates substantially in the same manner with the switching groove 14 as the actuator pins 15 with the first switching groove 14*a* of the first slide cam element 12*a*.

The carrier shaft 11 comprises a circular-disk-like locking element 19. Alternatively, other geometries are conceivable. The locking element 19 is arranged between the first and second slide cam elements 12*a*, 12*b*. The locking element 19 is axially delimited by the receiving element 18. The locking element 19 has a support function. The locking element 19 forms an abutment for the receiving element 18. The locking element 19 takes up the forces during the switching operation and thus enables fixing of the displacement element 16. Furthermore, the cooperation of the receiving element 18 and the locking element 19 prevents the first slide cam element 12*a* from being displaced undesirably. The receiving element 18 comprises two receiving members for the locking element 19. The locking element 19 comprises a recess. A displacement of the displacement element by the circular disk is thereby possible. For this purpose, the recess is arranged in the region of the corresponding rotation angle. The recess is arranged in the circular disk in such a manner that, during an axial movement, the displacement element 16 is moved through the recess. It is conceivable for the displacement element 16 further to comprise a spring/ball locking system (not illustrated).

In summary, the above-described slide cam system allows, as a result of the displacement element 16, a phase-shifted switching of the slide cam elements 12*a*, 12*b* using a single actuator. The total number of actuators in the slide cam system can thereby be substantially reduced.

Figure 5:
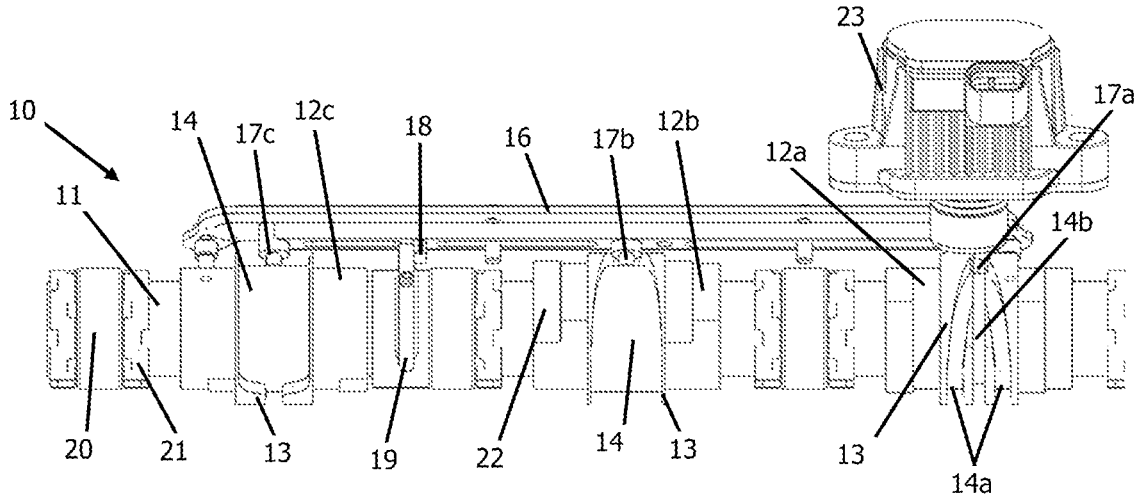
FIG. 5 is a perspective view of another example slide cam system.

FIG. 5 describes another embodiment of a slide cam system. The slide cam system substantially corresponds to the slide cam system according to FIGS. 1 to 4. The slide cam system illustrated comprises, unlike the above-described system, a third slide cam element 12*c* and the first slide cam element 12*a* has a differently shaped slotted switching member.

As in the embodiment above, the carrier shaft 11 comprises roller bearings 20 and retention rings 21. The roller bearings 20 and retention rings 21 are arranged at the axial ends of the carrier shaft 11 and between the slide cam elements 12*a*, 12*b*, 12*c*.

The displacement element 16 is arranged parallel with the carrier shaft 11. The displacement element 16 is guided in the rail and offset through from 45° to 60° in a peripheral direction relative to the actuator pins. The displacement can alternatively be, for example, 90°. The displacement element 16 comprises a third coupling pin 17*c* which is arranged in the region of the third slide cam element 12*c*.

An actuator 23 with the actuator pins 15 is arranged in the region of the first slide cam element 12*a*. The first slide cam element 12*a* has a Y-shaped first switching groove 14*a*.

The second switching groove 14*b* is constructed as a groove which extends over the entire periphery of the first slide cam element 12*a*, in particular as an annular groove. The radius of the second switching groove 14*b* is smaller than the radius of the first switching groove 14*a*. The first and second switching grooves 14*a*, 14*b* consequently have different rotation angles.

The first coupling pin 17*a* is permanently in engagement with the second switching groove 14*b* in the embodiment described above.

The continuous second switching groove 14*b* allows a direct displacement of the displacement element 16 without any time offset, that is to say, the displacement element 16 and the first slide cam element 12*a* move substantially at the same time.

The switching grooves 14 of the second and third slide cam elements 12*b*, 12*c* are arranged on the outer peripheral face in such a manner that the slide cam elements 12*b*, 12*c* can be switched in a temporally offset manner. The second and third coupling pins 17*b*, 17*c* cooperate with the switching grooves 14 in known manner, as already described in relation to FIGS. 1 to 4.

A locking element 19 is arranged between the second and third slide cam elements 12*b*, 12*c*. The locking element 19 comprises a circular disk with a recess. An extension is arranged on the displacement element 16 in the region of the circular disk. The circular disk forms an abutment for the extension. The circular disk cooperates with the extension during a displacement operation in such a manner that the first coupling pin is unloaded during the displacement operation. In other words, the extension is supported against the circular disk. The recess is arranged at the rotation angle at which the displacement of the first displacement element 16 is carried out.

Figure 6:
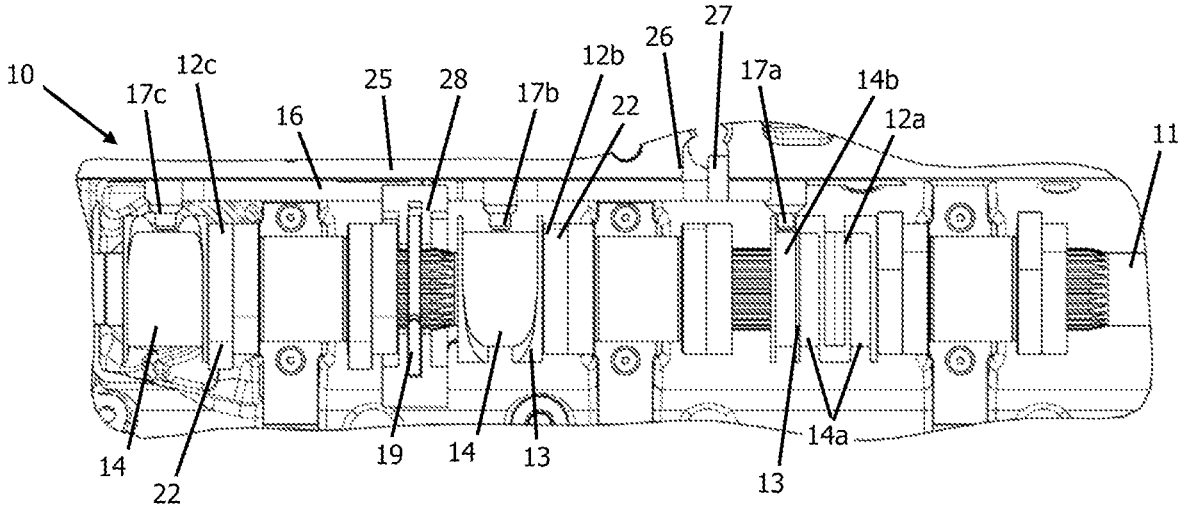
FIG. 6 is a side view of still another example slide cam system, which is in a cylinder head.

FIG. 6 illustrates another embodiment of a slide cam system. The slide cam system is arranged in a cylinder head 25.

The slide cam system comprises three slide cam elements 12*a*, 12*b*, 12*c*. In FIG. 5, the cam contours 22 surround the switching groove 14. In FIG. 6, the cam contours 22 of the slide cam elements 12*a*, 12*b*, 12*c* are arranged exclusively at one side in an axial direction beside the switching groove 14. The switching groove 14 will be discussed below in greater detail.

In this instance, the slide cam elements 12*a*, 12*b*, 12*c* have two cam portions 29, in which two cam contours 22 are constructed. In this case, a first cam portion 29*a* adjoins the slotted switching member 13 of the slide cam element 12*a*, 12*b*, 12*c*. A second cam portion 29*b* is arranged with spacing from the first cam portion 29*a* in an axial direction. The cam portions 29*a*, 29*b* of the respective slide cam elements 12*a*, 12*b*, 12*c* are constructed in an identical manner. Alternatively, it is possible for the cam portions 29*a*, 29*b* of the respective slide cam element 12*a*, 12*b*, 12*c* to be different from each other.

The total of two cam contours 22 per cam portion 29 form a stroke cam contour 31, a defined stroke and a zero stroke cam contour 32. This also applies to the cam contours 22 according to FIGS. 1 to 4. The two cam contours 31, 32 are provided adjacent to each other in an axial direction.

It is also possible for the respective cam portions 29 not to have any zero stroke cam contour 32, that is to say, instead of the zero stroke cam contour 32 they have an additional stroke cam contour 31. The three stroke cam contours 31 may have different strokes in this case.

By constructing the cam portions 29 with two different cam contours 22, the valve of a cylinder associated with the respective cam portion 29 can be controlled during operation into two different switching positions. Specifically, a defined stroke can be transmitted to the valve during operation by the stroke cam contour 31 and the valve can consequently be actuated. Additionally, the cylinder associated with the valve can be switched off during operation by the zero stroke cam contour 32. In this case, a two-step control of the valve of the cylinder is referred to.

The first slide cam element 12*a* comprises the first switching groove 14*a* and the second switching groove 14*b*. The first switching groove 14*a* has a Y-shaped slotted switching member 13. The second switching groove 14*b* extends in a peripheral direction of the first slide cam element 12*a*.

The switching grooves 14 of the second and third slide cam elements 12*b*, 12*c* are V-shaped.

The locking element 19 is arranged between the second and third slide cam elements 12*b*, 12*c*. The locking element 19 has a circular disk or an annular disk. The locking element 19 is arranged in a rotationally secure manner on the carrier shaft 11. The circular disk or annular disk has, as described in the preceding embodiments, a recess. The recess extends in a peripheral direction of the circular disk or annular disk.

The cylinder head 25 comprises an axial bearing in which the circular disk or annular disk of the locking element 19 is guided and/or supported.

The displacement element 16 is arranged in a manner offset relative to the actuator pins 15 at a rotation angle about the longitudinal axis of the carrier shaft 11. Coupling pins 17*a*, 17*b*, 17*c* are arranged on the displacement element 16 in a manner offset in an axial direction. The first coupling pin 17*a* engages in the second switching groove 14*b* of the first slide cam element 12*a*. The second coupling pin 17*b* engages in the switching groove 14 of the second slide cam element 12*b* and the third coupling pin 17*c* engages in the switching groove 14 of the third slide cam element 12*c*.

A spring/ball locking system 24 is arranged between the first and second coupling pins 17*a*, 17*b*. Instead of the ball, other forms are possible.

The displacement element 16 has a stop element 27. The stop element 27 is constructed as an extension which extends away in a direction orthogonal to a longitudinal direction of the displacement element 16. Other forms are possible. The stop element 27 is arranged between the first coupling pin 17*a* and the second coupling pin 17*b*. More specifically, the stop element 27 is arranged between the recesses or the notches for the spring/ball locking system 14 and the first coupling pin 17*a*.

The receiving element 18 is arranged between the second and third coupling pins 17*b*, 17*c*. The receiving element 18 has a single extension which extends in the direction of the camshaft 10.

A stop 26 is arranged in the cylinder head 25. The stop 26 is constructed as a recess in the cylinder head 25. The stop element 27 projects into the recess.

Figure 7:
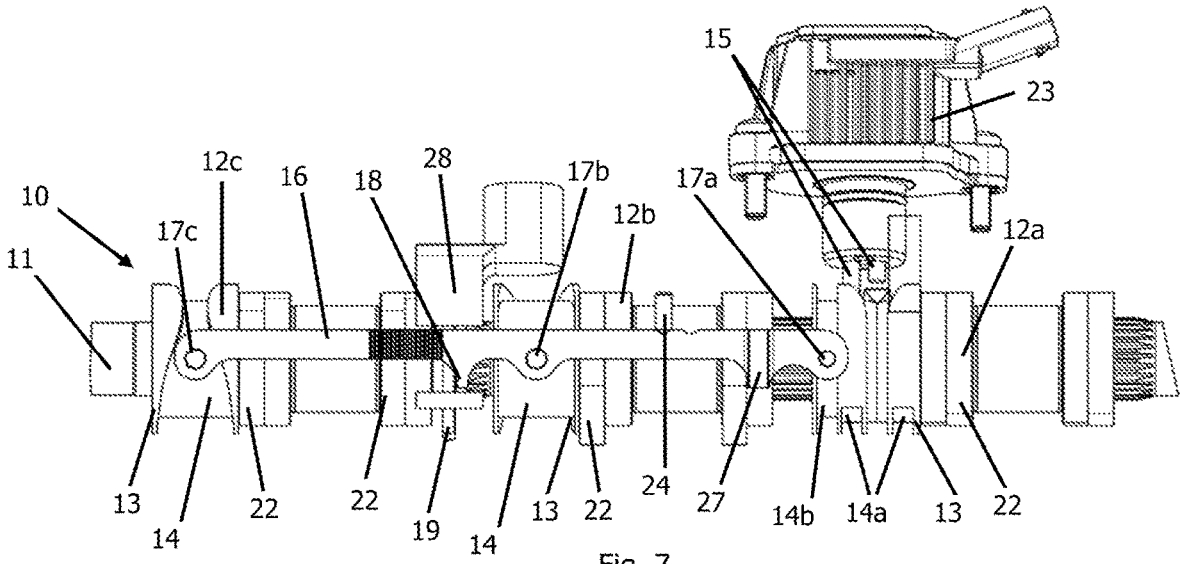
FIG. 7 is a further side view of the slide cam system according to FIG. 6.

FIG. 7 illustrates the embodiment according to FIG. 6 without the cylinder head 25.

FIG. 7 clearly shows the axial bearing 28 for the locking element 19. The axial bearing 28 is constructed as an individual element. The axial bearing has a connection portion which is connected to the cylinder head 25. Alternatively, the axial bearing can be constructed in one piece with the cylinder head 25. The axial bearing 28 comprises a through-gap.

Figure 8:
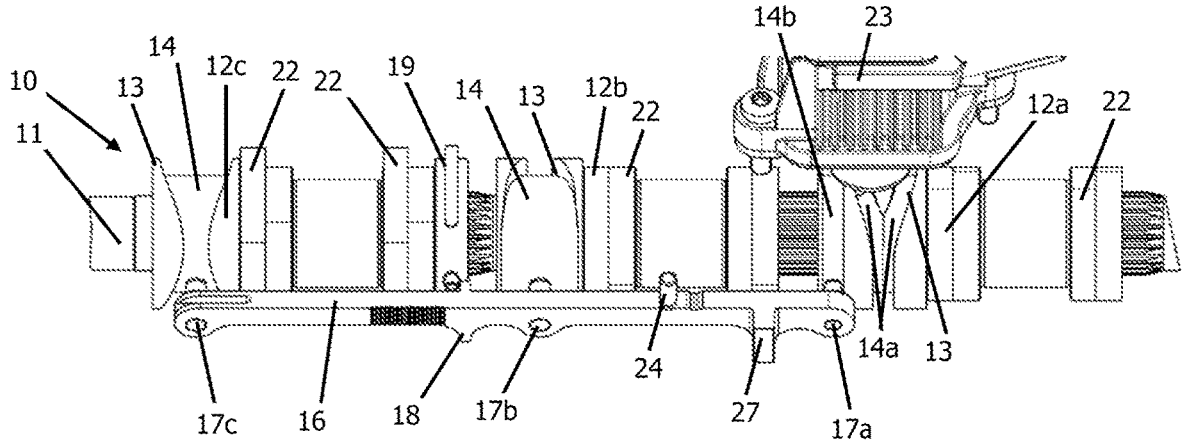
FIG. 8 is a side view of yet another example slide cam system.
Figure 9:
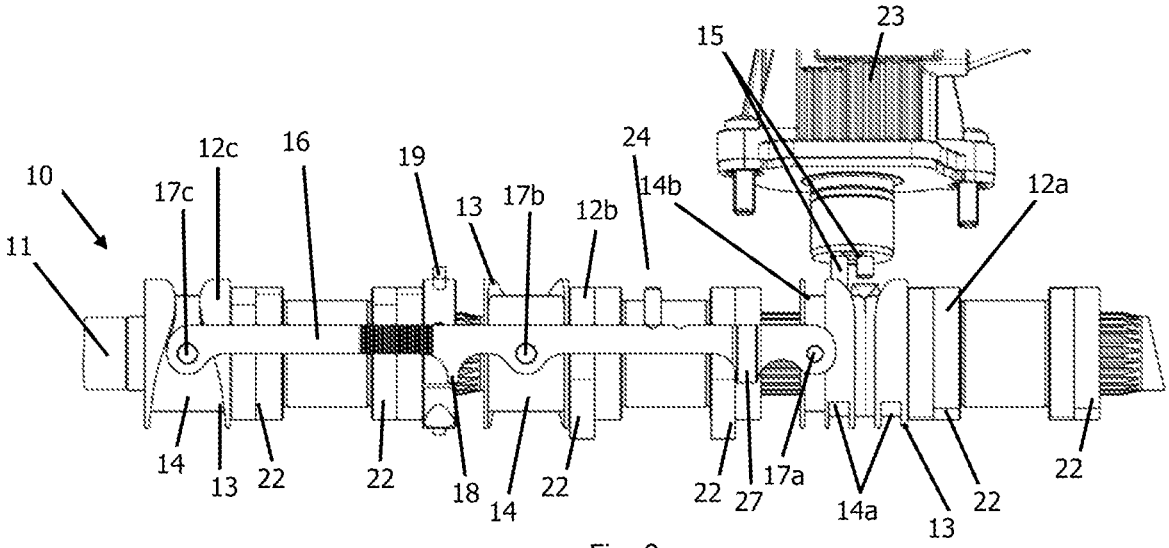
FIG. 9 is a further side view of the slide cam system according to FIG. 8.

The embodiments illustrated in FIG. 8 and FIG. 9 substantially correspond to the embodiment according to FIG. 6 and FIG. 7.

Unlike the embodiments illustrated in FIGS. 6 and 7, the cylinder head 25 in FIGS. 8 and 9 does not have any axial bearing 28 for the locking element 19. The locking element 19 is arranged on the carrier shaft 11 in a rotationally secure manner and so as to be fixed in an axial direction.

Figure 10:
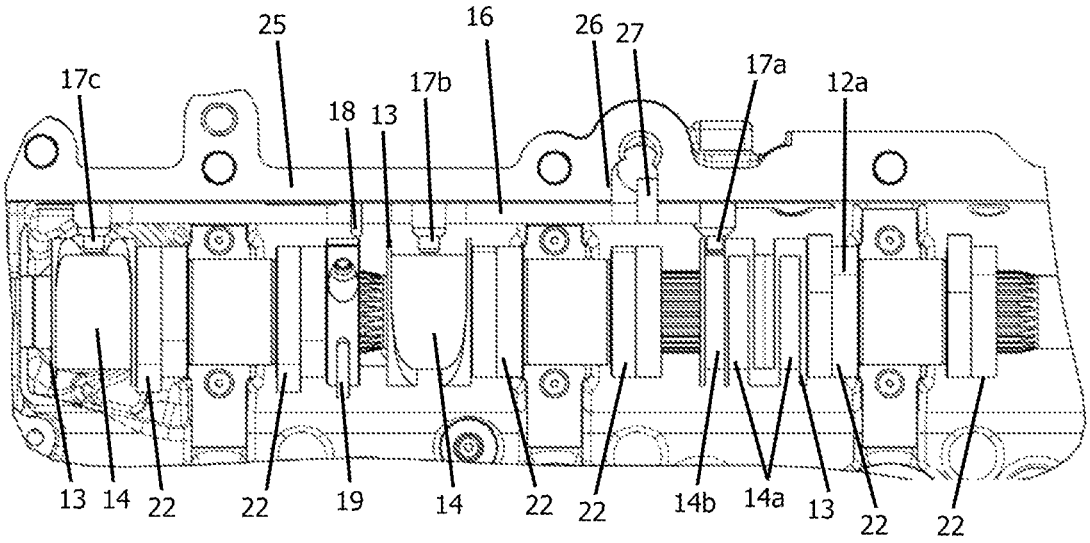
FIG. 10 is a side view of a further example slide cam system in a cylinder head.

FIG. 10 shows a combination of the embodiments illustrated in FIGS. 6 to 9, wherein a stop 26 is arranged in the cylinder head and the locking element 19 is rotationally secure and fixed in an axial direction on the carrier shaft 11.

The stop 26 in FIG. 10 is not absolutely necessary. Alternatively, the stop 26 may be dispensed with. Then, the delimitation of the freedom of movement of the displacement element 16 is carried out by the spring/ball locking system 24.

The first switching groove 14*a* of the first slide cam element 12*a* is used to receive the actuator pins 15. The second switching groove 14*b* is used to receive the first coupling pin 17*a*.

During a displacement of the displacement element 16, the receiving element 18 and the locking element 19 cooperate in such a manner that the receiving element 18 moves through the recess in the circular disk. In other words, the recess in the circular disk is arranged at a rotation angle relative to the longitudinal axis of the carrier shaft 11 in such a manner that the receiving element 18 changes from one side to the other of the circular disk when the first slide cam element 12*a* is displaced. During the displacement of the second and/or third slide cam element(s) 12*b*, 12*c*, the receiving element 18 is supported against the uninterrupted region of the circular disk. The circular disk or the annular disk can be acted on with the forces which act during displacement of the second and third slide cam elements 12*b*, 12*c*. The locking element 19 with the circular disk forms an abutment for the extension of the displacement element 16.

The locking element 19 allows two defined positions of the displacement element 16.

The stop 26 and the stop element 27 delimit the axial freedom of movement of the displacement element 16.

The spring/ball locking system 24 of the displacement element 16 prevents undesirable movements of the displacement element 16. The operational reliability is thereby improved. It is further possible for the spring/ball locking system 24 to perform the function of the stop 26 and the stop element 27. That is particularly advantageous when the locking element 19 is fixed on the carrier shaft in an axial direction.

The linear guide of the displacement element 16 is constructed in the cylinder head 25. Thus, an active oiling of the displacement element 16 is possible.

FIGS. 11 and 12 and 13 and 14 show two additional embodiments of a slide cam system. The slide cam systems according to FIGS. 11 to 14 substantially correspond to the slide cam system according to FIGS. 9 and 10. Unlike the slide cam system according to FIGS. 9 and 10, in this instance no extension is constructed as a stop element 27 on the displacement element 16. However, it is possible for the displacement element 16 to be able to have a stop element 27, as described in FIG. 6.

Furthermore, a three-step control of a valve of a cylinder is possible with the two slide cam systems according to FIGS. 11 to 14. In the slide cam systems according to FIGS. 1 to 8 and FIGS. 9 and 10, only a two-step control of a valve of a cylinder is possible because the respective cam portion has only two cam contours 22.

The two slide cam systems according to FIGS. 11 to 14 are arranged in a cylinder head 25 which is not illustrated.

The respective slide cam system comprises three slide cam elements 12*a*, 12*b*, 12*c*. The first slide cam element 12*a* has, as shown in FIGS. 6 to 10, a slotted switching member 13 having a first switching groove 14*a* and a second switching groove 14*b*. The first switching groove 14*a* is constructed in a Y-shaped manner. The first switching groove 14*a* can also be constructed in other forms.

The second switching groove 14*b* is, as in FIGS. 6 to 10, constructed as a radially peripheral groove. In other words, the second switching groove 14*b* is constructed as an annular groove. The second switching groove 14*b* is arranged at an axial end of the first slide cam element 12*a* and adjoins the first switching groove 14*a* in this case. Alternatively, the second switching groove 14*b* can be arranged at another axial position on the first slide cam element 12*a*.

The switching grooves 14 of the second and third slide cam elements 12*b*, 12*c* are constructed in a V-shaped manner.

The slide cam elements 12*a*, 12*b*, 12*c* each have two cam portions 29, in which three cam contours 22 are constructed. In this case, a first cam portion 29*a* adjoins the slotted switching member 13 of the slide cam element 12*a*, 12*b*, 12*c*. A second cam portion 29*b* is arranged with spacing from the first cam portion 29*a* in an axial direction. The cam portions 29*a*, 29*b* of the respective slide cam element 12*a*, 12*b*, 12*c* are constructed identically. Alternatively, it is possible for the cam portions 29*a*, 29*b* of the respective slide cam element 12*a*, 12*b*, 12*c* to be different from each other.

The total of three cam contours 22 per cam portion 29 form two stroke cam contours 31 with different strokes and a zero stroke cam contour 32. The two stroke cam contours 31 are provided adjacent to each other in an axial direction. The zero stroke cam contour 32 adjoins one of the two stroke cam contours 31 in an axial direction.

It is also possible for the respective cam portions 29 not to have a zero stroke cam contour 32, that is to say, instead of the zero stroke cam contour 32 an additional stroke cam contour 31. The three stroke cam contours 31 may have different strokes in this case.

By constructing the cam portions 29 with three different contours 31, 32, the valve, which is associated with the respective cam portion 29, of a cylinder can be controlled into three different switching positions during operation. Specifically, during operation two different strokes can be transmitted to the valve by the two stroke cam contours 31 and consequently the valve can be actuated. Additionally, during operation the cylinder associated with the valve can be switched off by the zero stroke cam contour 32. A three-step control of the valve of the cylinder is referred to in this instance.

Figure 11:
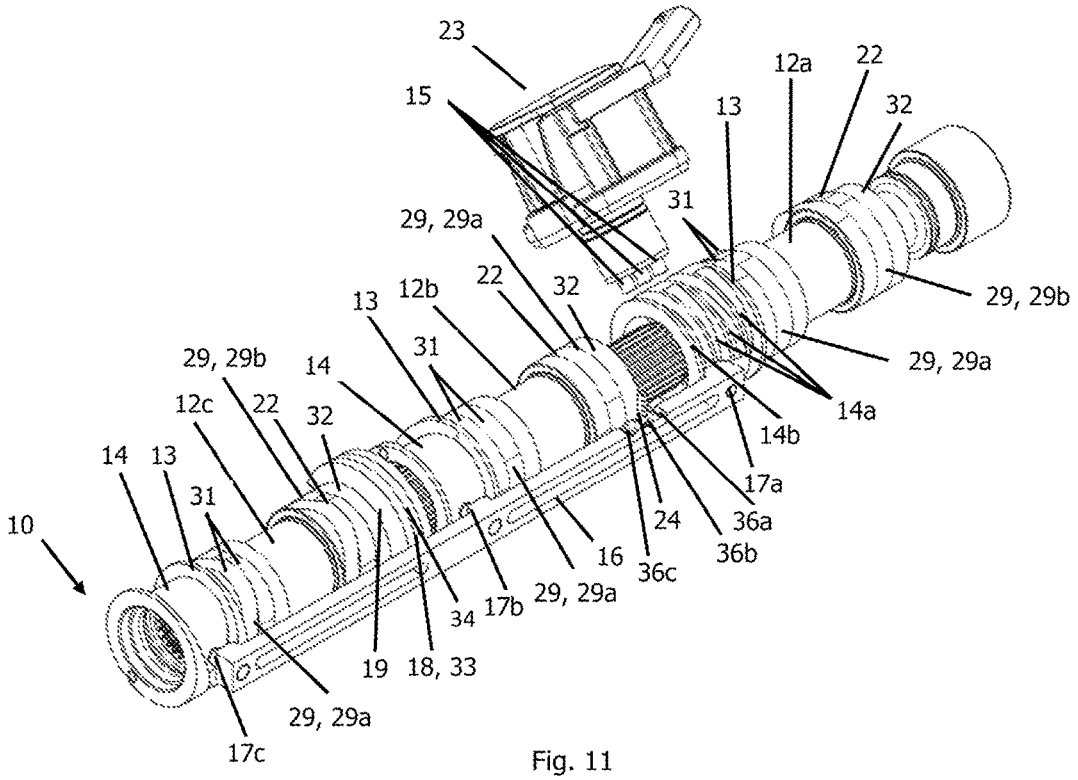
FIG. 11 is a perspective view of still a further example slide cam system.
Figure 12:
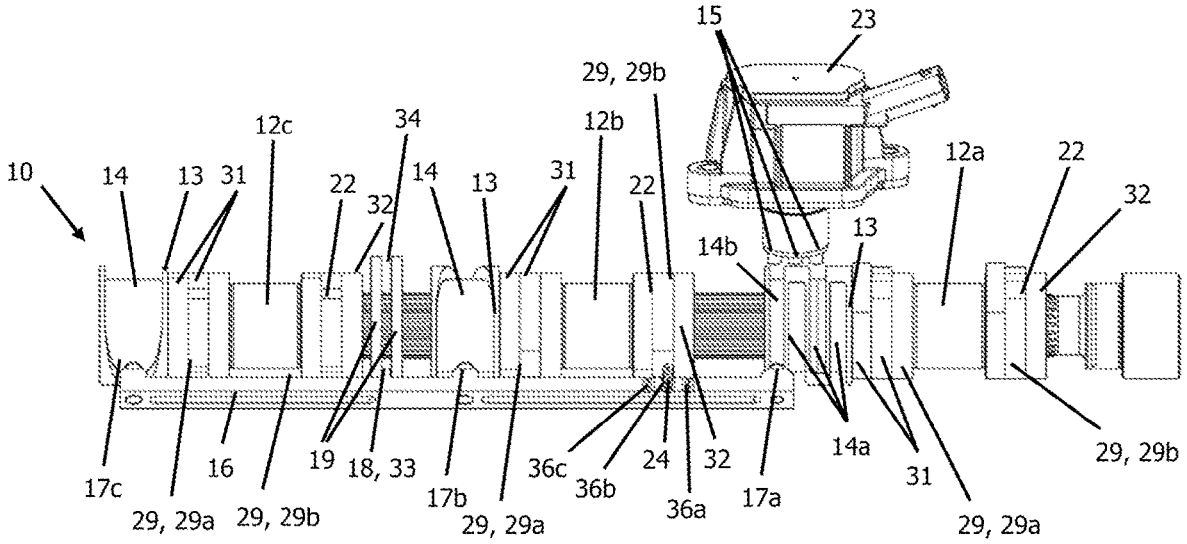
FIG. 12 is a side view of the slide cam system according to FIG. 11.

The slide cam system according to FIGS. 11 and 12 has two locking elements 19 which are arranged in a rotationally secure manner on the carrier shaft 11. The locking elements 19 are arranged axially between the second and third slide cam elements 12*b*, 12*c*. The locking elements 19 are each formed by a circular disk or an annular disk. The respective circular disk or an annular disk has, as described in the preceding embodiments, a recess. The recess extends in a peripheral direction of the circular disk or annular disk.

The two locking elements 19 are axially spaced apart from each other. The spacing between the two locking elements 19 substantially corresponds to the width of a receiving element 18 of the displacement element 16. The receiving element 18 is formed by a single extension 33 which extends in the direction of the camshaft 10. The extension 33 is constructed in such a manner that an intermediate space 34 can receive the extension 33 axially between the two locking elements 19. The receiving element 18 is arranged between the second and third coupling pins 17*b*, 17*c*.

Figure 13:
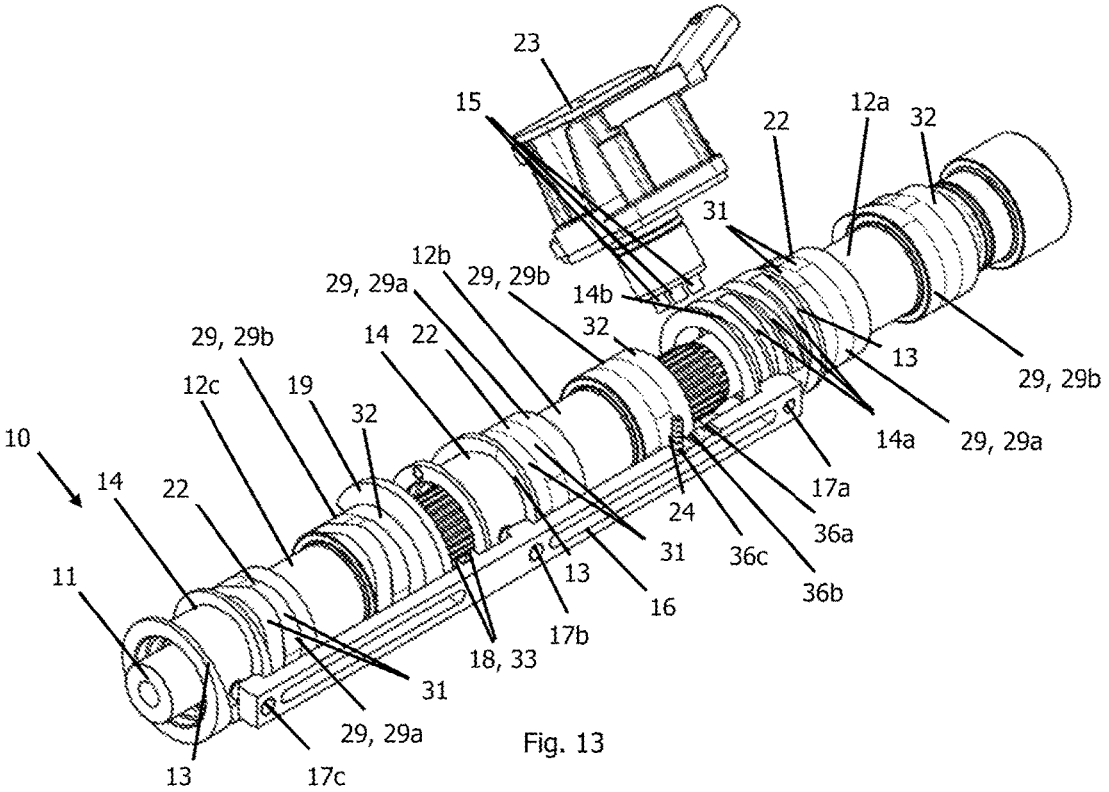
FIG. 13 is a perspective view of another example slide cam system.
Figure 14:
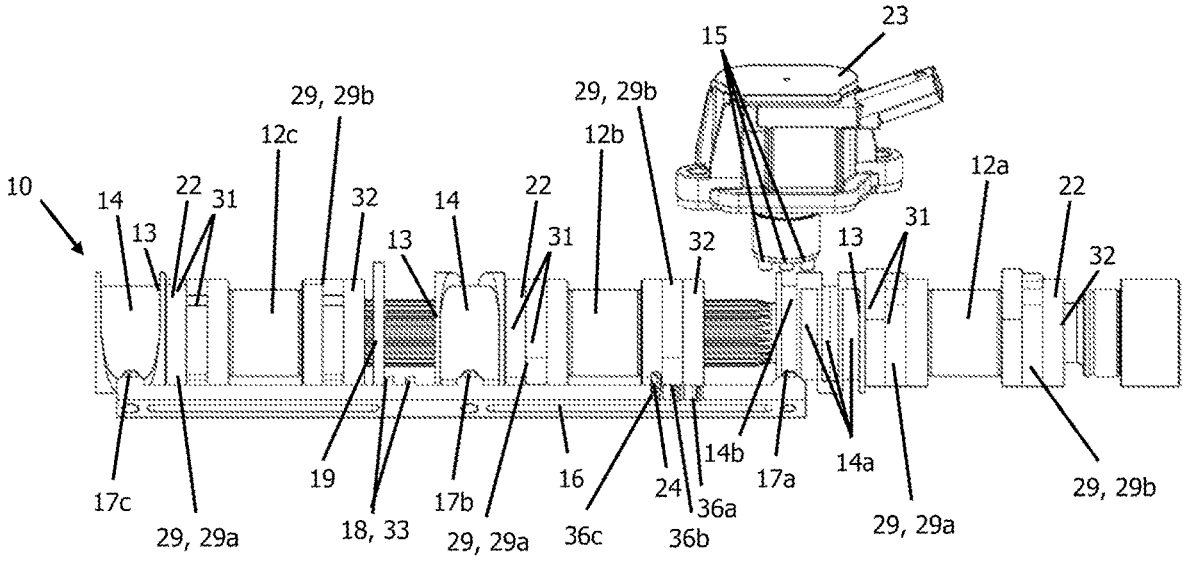
FIG. 14 is a side view of the slide cam system according to FIG. 13.

Unlike the slide cam system according to FIGS. 11 and 12, in the slide cam system according to FIGS. 13 and 14 only one locking element 19 is arranged on the carrier shaft 11 in a rotationally secure manner. Here, however, the displacement element 16 has a total of two receiving elements 18 in the form of extensions 33 instead of one receiving element 18. The two receiving elements 18 extend in the direction of the longitudinal axis of the carrier shaft 11 and together form a fork-like form.

The displacement element 16 according to FIGS. 11 to 14 is arranged in a manner offset relative to the actuator pins 15 at a rotation angle about the longitudinal axis of the carrier shaft 11. Coupling pins 17*a*, 17*b*, 17*c* are arranged on the displacement element 16 in a manner offset in an axial direction. The first coupling pin 17*a* engages in the second switching groove 14*b* of the first slide cam element 12*a*. The second coupling pin 17*b* engages in the switching groove 14 of the second slide cam element 12*b* and the third coupling pin 17*c* engages in the switching groove 14 of the third slide cam element 12*c*.

According to FIGS. 11 to 14, there is further arranged a multiple actuator 23 in the region of the first slide cam element 12*a*, which has a total of three actuator pins 15. As a result of the three actuator pins 15, a total of three axial positions of the three slide cam elements 12*a*, 12*b*, 12*c* are possible.

As described above, the first coupling pin 17*a* is permanently in engagement with the second switching groove 14*b*. The continuously extending second switching groove 14*b* allows direct displacement of the displacement element 16 without any temporal offset, that is to say, the displacement element 16 and the first slide cam element 12*a* move substantially simultaneously.

During axial displacement, one of the three actuator pins 15 engages in the first switching groove 14*a* so that the first slide cam element 12*a* is moved in an axial direction by the path of the first switching groove 14*a*. In this case, the first slide cam element 12*a* and the displacement element 16 are pushed from a first axial position 36*a* into a second axial position 36*b*, in particular an axial position which is central in the longitudinal direction of the carrier shaft 11. As a result of the coupling pins 17*a*, 17*b*, the second and third slide cam elements 12*b*, 12*c* are axially offset in this case in a temporally offset manner.

In the slide cam system according to FIGS. 11 and 12, the individual extension 33 is moved by a first of the two locking elements 19 into the intermediate space 34 between the two locking elements 19, wherein the extension 33 transmits the occurring displacement forces of the second and third slide cam elements 12*b*, 12*c* to the second locking element 19. The extension 33 is located in the second axial position 36*b* between the two locking elements 19.

In the slide cam system according to FIGS. 13 and 14, in this instance a first of the two extensions 33 is axially moved through the cutout of the locking element 19, wherein the first extension 33 transmits the occurring displacement forces of the second and third slide cam elements 12*b*, 12*c* to the individual locking element 19. The locking element 19 is located in the second axial position 36*b* in a region of the outer periphery between the two extensions 33.

As a result of the engagement of the second pin, in particular the central pin in the longitudinal direction of the carrier shaft 11, of the three actuator pins 15 in the first switching groove 14*a*, the first slide cam element 12*a* is pushed with the displacement element 16 to a third, in particular last, axial position 36*c*. As a result of the coupling pins 17*b*, 17*c*, in this case the second and third slide cam elements 12*b*, 12*c* are axially displaced further in a temporally offset manner.

In the slide cam system according to FIGS. 11 and 12, the extension 33 changes in this case from the intermediate space 34 between the two locking elements 19 axially outward and cooperates with the second locking element 19 in order to transmit the displacement forces. The extension 33 is located at the third axial position 36*c* at the outer side of the second locking element 19. In order to reverse the displacement operation, the third actuator pin 15 engages in the first switching groove 14*a*, whereby the axial displacement direction occurs in the opposite manner.

In the slide cam system according to claims 13 and 14, the second extension 33 changes in this instance from the intermediate space 34 between the two locking elements 19 axially outward and cooperates with the second locking element 19 in order to transmit the displacement forces. The extension 33 is located at the third axial position 36*c* at the outer side of the second locking element 19. In order to reverse the displacement operation, the third actuator pin 15 engages in the first switching groove 14*a*, whereby the axial displacement direction occurs in the opposite manner.

In the slide cam system according to FIGS. 13 and 14, a second extension of the two extensions 33 is moved axially through the cutout of the locking element 19 in this case, wherein the second extension 33 transmits the occurring displacement forces of the second and third slide cam elements 12*b*, 12*c* to the individual locking element 19. The second extension 33 is located in the third axial position 36*c* at the other outer side of the locking element 19.

A spring/ball locking system 24 is arranged between the first and the second coupling pins 17*a*, 17*b* in order to releasably fix the displacement element 16 in a longitudinal direction at the axial positions 36*a*, 36*b*, 36*c*. Other forms are possible instead of the ball.

In summary, in the slide cam systems according to the invention for a three-step control of a valve, a total of three cam contours, in particular stroke cam contours 31, zero stroke contours 32, and a multiple actuator 23 with at least three actuator pins 15 are necessary.

Figure 15:
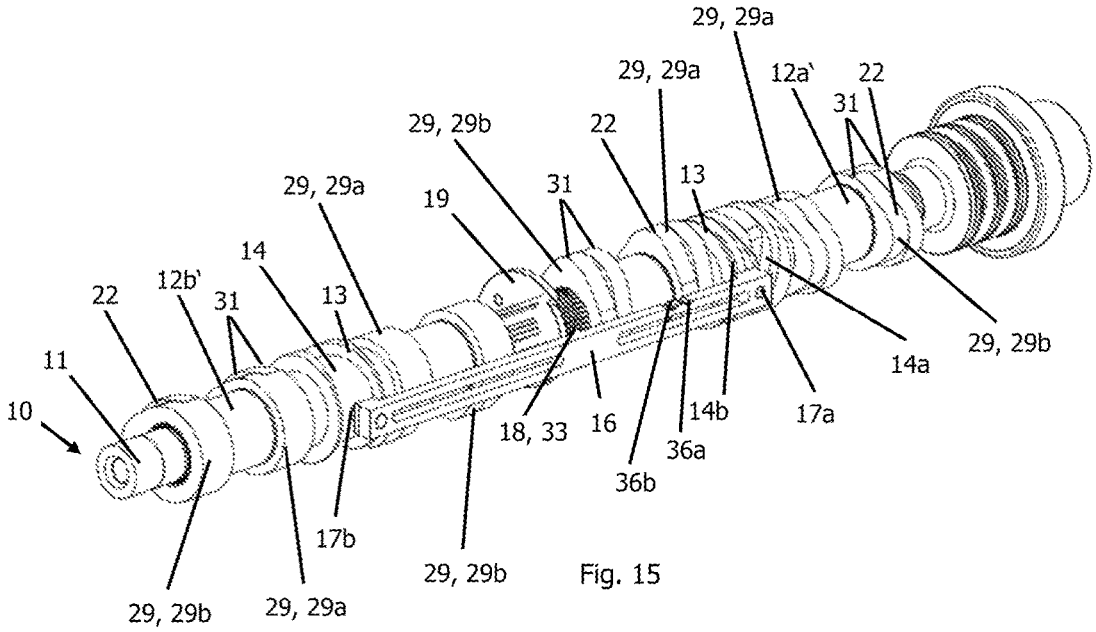
FIG. 15 is a perspective view of another example slide cam system.
Figure 16:
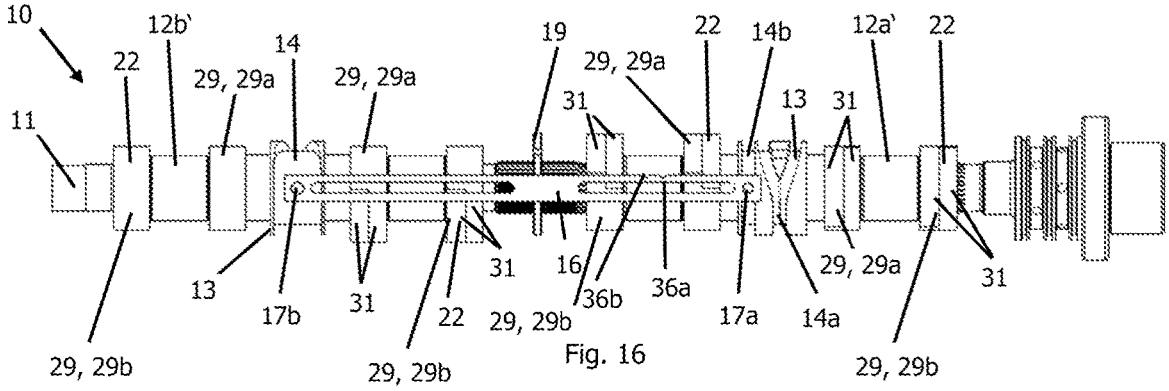
FIG. 16 is a side view of the slide cam system according to FIG. 15.

Unlike the slide cam system according to FIGS. 1 to 4, the slide cam system shown in FIGS. 15 and 16 has, instead of two slide cam elements for controlling valves of only one cylinder, two double slide cam elements which are constructed to control valves of two cylinders.

The slide cam system according to FIGS. 15 and 16 is also arranged in a cylinder head 25 which is not illustrated.

The first element of the two double slide cam elements 12*a*', 12*b*' has a slotted switching member 13 having a first switching groove 14*a* and a second switching groove 14*b*. The configuration of the slotted switching member 13 and the switching grooves 14*a*, 14*b* are constructed and arranged as described in FIGS. 11 to 14.

The switching groove 14 of the second double slide cam element 12*b*' is constructed in a V-shaped manner.

The double slide cam elements 12*a*', 12*b*' each have four cam portions 29, in which two cam contours 22' are constructed. In this case, two cam portions 29 are arranged in a longitudinal direction at an axial side of the slotted switching member 13. In other words, the slotted switching member 13 is arranged axially between two pairs of the cam portions 29. In this case, the first two cam portions 29*a* of the pairs adjoin the slotted switching member 13 of the double slide cam elements 12*a*', 12*b*'. The second cam portion 29*b* of the respective pair is arranged with spacing from the first cam portion 29*a* of the same pair in an axial direction. The cam portions 29*a*, 29*b* of the respective double slide cam element 12*a*', 12*b*' are constructed in an identical manner. Alternatively, it is possible for the cam portions 29*a*, 29*b* of the respective double slide cam element 12*a*', 12*b*' to be different from each other.

The total of two cam contours 22 per cam portion 29 form two stroke cam contours 31 with different strokes. The stroke cam contours 31 are provided so as to adjoin each other in an axial direction.

It is also possible for the respective cam portions 29 to have one zero stroke cam contour 32 instead of one of the stroke cam contours 31.

By constructing the cam portions 29 with two different stroke cam contours 31, the valve of a cylinder associated with the respective cam portion 29 can during operation be controlled into two different switching positions. Specifically, during operation two different strokes can be transmitted to the valve by the stroke cam contours 31 and consequently the valve can be actuated. A two-step control of the valve of the cylinder is referred to here.

Alternatively, it is also possible for the cam portions 29 of the double slide cam elements 12*a*', 12*b*' to have a total of three cam contours 22 so that a three-step control of a valve of a cylinder is enabled.

The displacement operation of the double slide cam elements 12*a*', 12*b*' is carried out as described in FIGS. 1 to 4. In FIGS. 15 and 16, only the actuator with the two actuator pins 15 is not illustrated. Furthermore, the configuration of the displacement element 16 and the locking element 19 corresponds, as described in FIGS. 13 and 14. These elements differ only in terms of the number of possible axial positions. According to FIGS. 15 and 16, only two axial positions are possible during the axial displacement of the double slide cam elements 12*a*', 12*b*'. Furthermore, two receiving elements 19 or extensions 33 are not provided, unlike in relation to FIGS. 13 and 14, but instead only a single extension 33.

During operation, the extension 33 transmits the occurring displacement forces of the second double slide cam element 12*b*' to the locking element 19 in a manner dependent on the respective axial position. The locking element 19 is configured as described in FIGS. 11 to 14. Furthermore, the axial displacement operation in the slide cam system according to FIGS. 15 and 16 is carried out as described in FIGS. 1 to 4.

Figure 17:
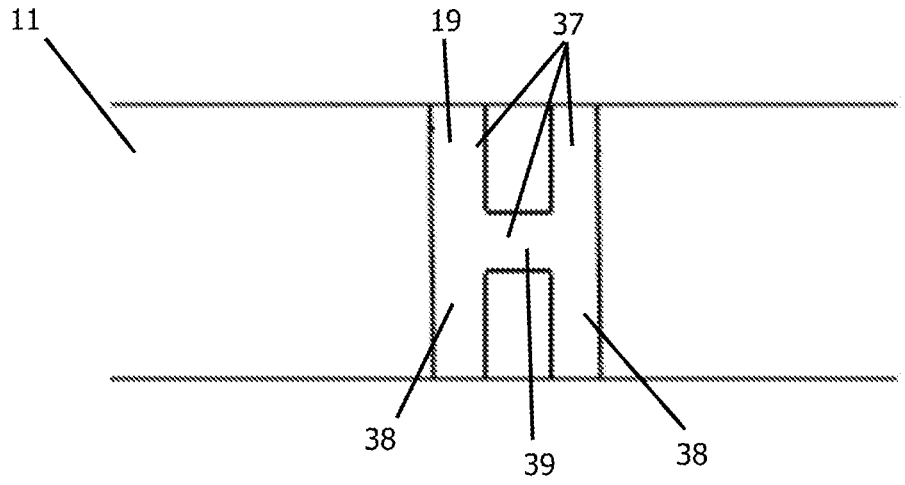
FIG. 17 is a schematic view of an example carrier shaft of a further example slide cam system.

According to FIG. 17, a carrier shaft 11 of another embodiment of a slide cam system is shown. The locking element 19 is integrally constructed with the carrier shaft 11 here unlike the above-described slide cam systems. The locking element 19 is formed by a recess 37 in the carrier shaft 11 in this case. The recess 37 can be constructed by milling and/or turning. The recess 37 is formed by two peripheral grooves 38 and one longitudinal passage 39 which connects the grooves 38. The grooves 38 are constructed in a radially peripheral manner in the carrier shaft 11.

During operation, the receiving element 18 is arranged partially in one of the two grooves 38 in a manner dependent on the respective axial position 36*a*, 36*b* of the slide cam element 12*a*, 12*b* or double slide cam element 12*a*', 12*b*'. If, during operation, the axial position 36*a*, 36*b* and consequently of the displacement element 16 is changed during a displacement operation, the receiving element 18 travels through the longitudinal passage 39 and changes from the first groove 36*a* into the second peripheral groove 36*b*. In this case, the receiving element 18 is supported against the groove walls in order to transmit the forces occurring during the axial displacement to the carrier shaft 11. This configuration of the recess 37 is used in a two-step control of the valves, in particular by two contours of the respective cam portions 29. The locking element 19 in the form of a recess 37 of the carrier shaft 11 can be used in the slide cam systems according to FIGS. 1 to 4 and/or FIGS. 15 and 16.

In a three-step control of the valves, in particular by three contours of the respective cam portions 29, the recess 37 can be formed by a total of three peripheral grooves 38 and two longitudinal passages 39. In this case, one longitudinal passage 39 connects two grooves 38 so that, during an axial displacement of the slide cam elements 12*a*, 12*b* or double slide cam elements 12*a*', 12*b*', a total of three axial positions 36*a*, 36*b*, 36*c* are possible. The force transmission from the receiving element 18 to the carrier shaft 11 can be carried out as described above.

Figure 18:
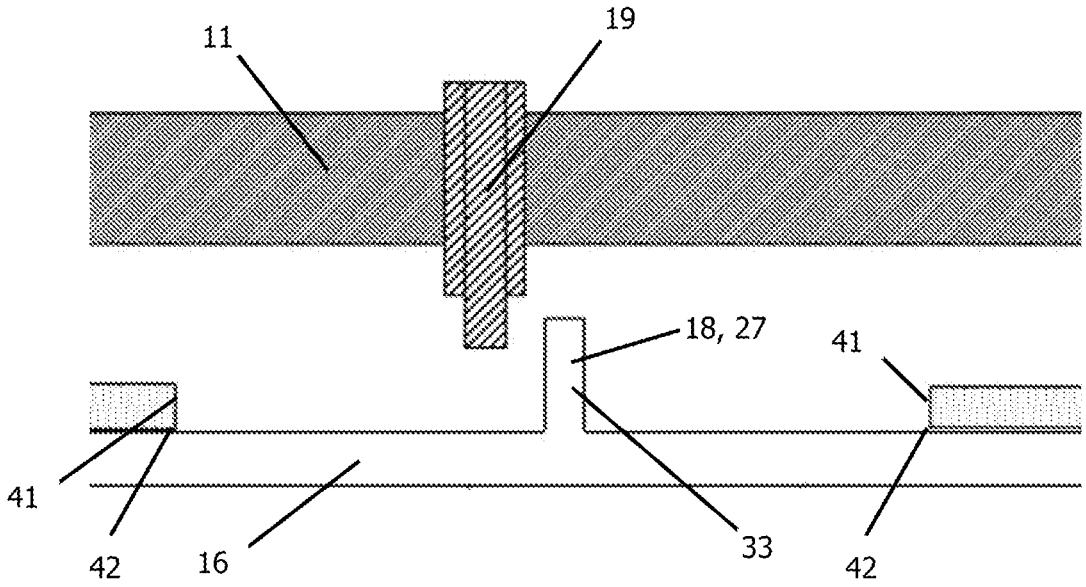
FIG. 18 is a schematic view of an example carrier shaft with a locking element and a displacement element of one example slide cam system.
Figure 19:
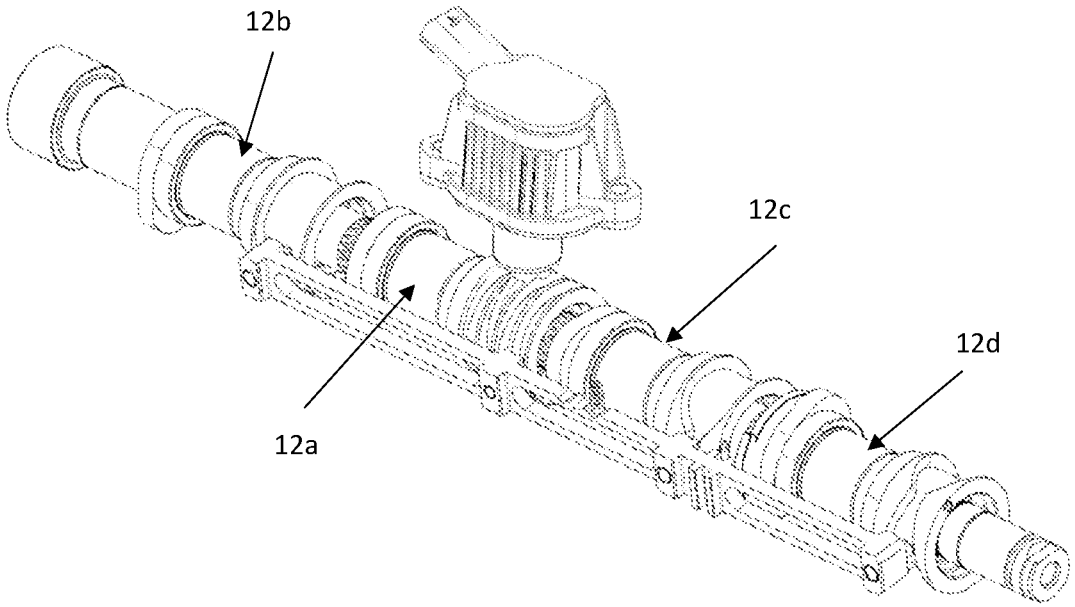
FIG. 19 shows a slide cam system according to the disclosure with a Y-shaped groove.
Figure 20:
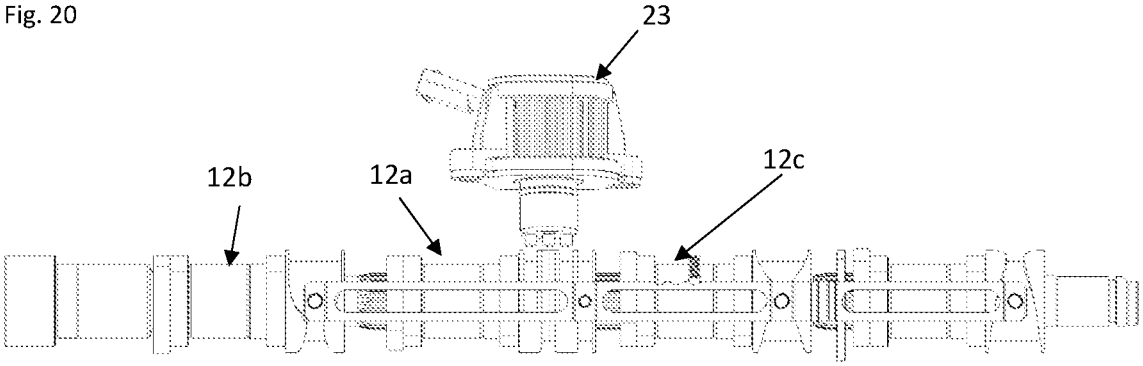
FIG. 20 shows a slide cam system according to the disclosure with a first slide cam element and the multiple actuator disposed in a longitudinal direction of the carrier shaft centrally between the second and third slide cam elements.
Figure 21:
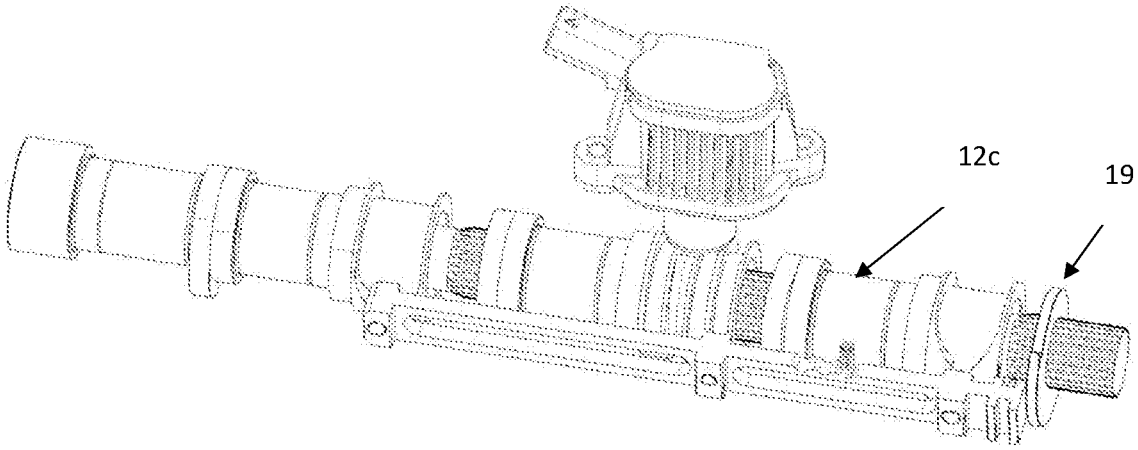
FIG. 21 shows a slide cam system according to the disclosure a carrier shaft having a locking element that cooperates with the receiving element during operation of the slide cam system such that the displacement element is locked between two positional changes.
Figure 22:
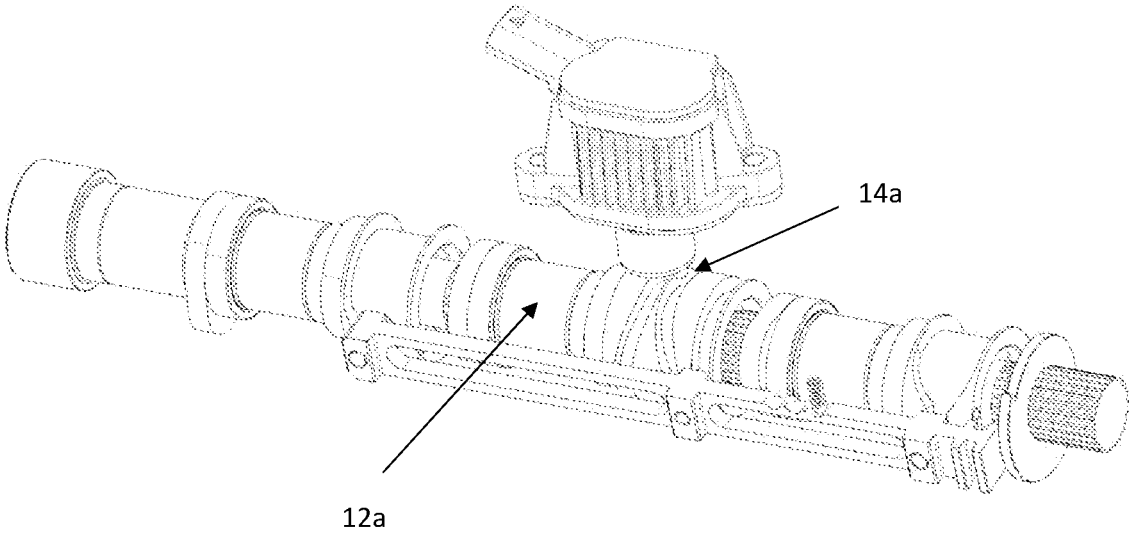
FIG. 22 shows a slide cam system according to the disclosure with an S-shaped groove.

FIG. 18 shows a schematic illustration of part of another embodiment of a slide cam system. The slide cam system has a carrier shaft 11 having a locking element 19. In this instance, the locking element 19 can be configured as described in FIGS. 11 to 14. FIG. 18 further shows a displacement element 16 having a receiving element 18 which is constructed as an extension 33. The extension 33 is also configured as described in FIGS. 11 to 14. In the slide cam system according to FIG. 18, the receiving element 18 is used not only to transmit forces or for support, but additionally also as a stop which delimits the axial displacement path. Alternatively or additionally, stop regions 41 against which the displacement element 16 stops in a displacement direction in order to delimit the axial displacement path are provided here in a cylinder head which is not illustrated. For this purpose, the displacement element 16 has two stop ends 42 which form the longitudinal ends of the displacement element 16 which during operation stop against the respective stop region 41. Other alternatives for delimiting the axial displacement path are possible.

The embodiments of the invention described can be combined with each other, as illustrated, for example, in FIG. 10, and are not limited to the variants described. In particular, the slide cam systems according to FIGS. 1 to 5 and 11 to 17 may have a stop element 27, as described in FIG. 7. This applies not only to the configuration of the stop element 27 but also to the type of construction and the cooperation with the cylinder head cover 25.

LIST OF REFERENCE NUMERALS

10 Camshaft
11 Carrier shaft
12*a* First slide cam element
12*b* Second slide cam element
12*c* Third slide cam element
13 Slotted switching member
14 Switching groove
14*a* First switching groove
14*b* Second switching groove
15 Actuator pin
16 Displacement element
17*a* First coupling pin
17*b* Second coupling pin
17*c* Third coupling pin
18 Receiving element
19 Locking element
20 Roller bearing
21 Retention rings

22 Cam contour
23 Actuator, multiple actuator
24 Spring/ball locking system
25 Cylinder head
26 Stop
27 Stop element
28 Axial bearing
29 Cam portion
29*a* First cam portion
29*b* Second cam portion
31 Stroke cam contour
32 Zero stroke cam contour
33 Extension
34 Intermediate space
36*a* First axial position
36*b* Second axial position
36*c* Third axial position
37 Recess
38 Peripheral grooves
39 Longitudinal passage
41 Stop regions

What is claimed is:

1. A slide cam system for an internal combustion engine having a camshaft comprising:

a carrier shaft having a first slide cam element and a second slide cam element each comprising at least one slotted switching member each having at least one switching groove;

an actuator pin, wherein the first and second slide cam elements are displaceable axially relative to the carrier shaft by the actuator pin; and a displacement element disposed parallel with a longitudinal axis of the carrier shaft, wherein the displacement element is axially displaceable in a direction of the longitudinal axis of the carrier shaft, wherein the displacement element comprises:

a first coupling pin that is disposed in a region of the first slide cam element, and a second coupling pin that is disposed in a region of the second slide cam element, wherein the first and second coupling pins cooperate with the at least one slotted switching member of the respective first and second slide cam elements such that as a result of the displacement element element a movement initiated by the actuator pin of the first slide cam element is configured to be transmitted to the second slide cam element, and wherein the displacement element comprises a receiving element, wherein the carrier shaft comprises a locking element that cooperates with the receiving element during operation of the slide cam system such that the displacement element is locked between two positional changes.

2. The slide cam system of claim 1 wherein the locking element forms an abutment for the receiving element so that the locking element is configured to be acted on at least partially by forces present during a positional change of the second slide cam element.

3. The slide cam system of claim 1 wherein the displacement element comprises a spring/ball locking system.

4. The slide cam system of claim 1 wherein the actuator pin and the first and second coupling pins are offset by 90° in a peripheral direction of the carrier shaft.

5. The slide cam system of claim 1 wherein the at least one switching groove of the at least one slotted switching member of the first slide cam element is a first switching groove, wherein the at least one slotted switching member of the first slide cam element includes a second switching groove, with the first switching groove configured to receive the actuator pin and the second switching groove configured to receive the first coupling pin.

6. The slide cam system of claim 5 wherein the first switching groove and the second switching groove have a same rotation angle, wherein a radius of the first switching groove is greater than a radius of the second switching groove.

7. The slide cam system of claim 6 wherein the first and second switching grooves of the first slide cam element include an at least partially V-shaped profile.

8. The slide cam system of claim 1 wherein the at least one switching groove of the first slide cam element includes an at least partially Y-shaped profile.

9. The slide cam system of claim 8 wherein the at least one switching groove of the at least one slotted switching member of the first slide cam element is a first switching groove, wherein the first slide cam element includes a second switching groove configured to receive the first coupling pin that is arranged such that the displacement element is directly displaceable.

10. The slide cam system of claim 1 wherein the at least one switching groove of the first slide cam element includes regions with different radii, wherein one of the regions is an introduction region, one of the regions is a displacement region, and one of the regions is a discharge region.

11. The slide cam system of claim 1 wherein the at least one slotted switching member of the second slide cam element includes an at least partially V-shaped profile.

12. The slide cam system of claim 1 comprising a third slide cam element and a fourth slide cam element.

13. The slide cam system of claim 1 wherein the first and second slide cam elements are double slide cam elements, wherein each of the double slide cam elements is configured to control valves of two cylinders.

14. The slide cam system of claim 1 wherein the at least one switching grooves of the first and second slide cam elements are offset relative to each other at a rotation angle so that the second slide cam element is displaceable in a longitudinal direction of the carrier shaft in a temporally offset manner relative to the first slide cam element.

15. The slide cam system of claim 1 wherein the second slide cam element and a third slide cam element each have at least partially V-shaped profiles, wherein the V-shaped profiles each have a constant radius.

16. The slide cam system of claim 1 wherein the at least one switching grooves of the first slide cam element and the second slide cam element and a switching groove of a third slide cam element are offset relative to each other at a rotation angle such that the second and third slide cam elements are displaceable in a temporally offset manner relative to the first slide cam element in a longitudinal direction of the carrier shaft.

17. The slide cam system of claim 1 wherein the first and second slide cam elements each have at least four cam portions for controlling valves of two cylinders, with a stroke cam contour being configured in the at least four cam portions to actuate the valve of one of the two cylinders.

18. The slide cam system of claim 1 wherein the first and second slide cam elements each have cam portions for controlling a valve of a cylinder, with a stroke cam contour being configured to actuate the valve.

19. The slide cam system of claim 18 wherein each cam portion includes at least three stroke cam contours for actuating the valve, wherein the at least three stroke cam contours each comprise different strokes.

20. The slide cam system of claim 18 wherein in addition to the stroke cam contour each cam portion includes a zero stroke cam contour for switching off the cylinder associated with the valve, wherein the zero stroke cam contour adjoins the stroke cam contour.

21. The slide cam system of claim 1 comprising a multiple actuator that includes at least three actuator pins by way of which the first and second slide cam elements and a third slide cam element are movable into multiple axial positions to allow different switching positions for valves.

22. The slide cam system of claim 21 wherein the first slide cam element and the multiple actuator are disposed in a first axial region of the carrier shaft, wherein at least one of the second slide cam element or the third slide cam element is disposed in a second axial region of the carrier shaft that adjoins the first axial region.

23. The slide cam system of claim 21 wherein the first slide cam element and the multiple actuator are disposed in a longitudinal direction of the carrier shaft centrally between the second and third slide cam elements.

24. The slide cam system of claim 1 wherein the displacement element comprises the receiving element, wherein the carrier shaft comprises the locking element that cooperates with the receiving element during operation of the slide cam system such that the displacement element is locked between two positional changes, wherein the locking element includes at least partially a circular disk or an annular disk, wherein the locking element is disposed between the first and second slide cam elements, or between the second slide cam element and a third slide cam element, or between an axle end of the carrier shaft and one of the first, second or third slide cam elements.

25. The slide cam system of claim 1 wherein the displacement element comprises the receiving element, wherein the carrier shaft comprises the locking element that cooperates with the receiving element during operation of the slide cam system such that the displacement element is locked between two positional changes, wherein the locking element is integral with the carrier shaft, wherein the locking element is configured as at least two peripheral grooves and a longitudinal passage that connects the at least two peripheral grooves in the carrier shaft.

26. The slide cam system of claim 1 wherein the displacement element comprises the receiving element, wherein the carrier shaft comprises the locking element that cooperates with the receiving element during operation of the slide cam system such that the displacement element is locked between two positional changes, the slide cam system comprising a camshaft bearing configured as a roller bearing or a sliding bearing, wherein a portion of the camshaft bearing forms the locking element.

27. The slide cam system of claim 1 wherein the carrier shaft includes the locking element comprises locking elements, wherein the receiving element of the displacement element forms an extension configured to cooperate during operation of the slide cam system with at least one of the locking elements so that at least one of the locking elements is at least partially acted on by forces present during a positional change of the second slide cam element or a third slide cam element.

28. The slide cam system of claim 1 wherein the carrier shaft includes the locking element, wherein the receiving element of the displacement element forms at least two extensions that are configured to cooperate during operation of the slide cam system with the locking element such that the locking element is at least partially acted on by forces present during a positional change of the second slide cam element or a third slide cam element.

29. The slide cam system of claim 1 comprising a stop element on the displacement element configured to cooperate with a stop in a cylinder head or a cylinder head cover to limit axial displacement of the displacement element.

30. The slide cam system of claim 29 wherein the receiving element of the displacement element is the stop element, wherein during operation of the slide cam system the receiving element is configured to limit the axial displacement of the displacement element.

31. The slide cam system of claim 1 wherein the displacement element includes in a displacement direction a stop end configured to cooperate during operation of the slide cam system with a cylinder head to limit axial displacement of the displacement element.

32. The slide cam system of claim 1 wherein the displacement element comprises the receiving element, wherein the carrier shaft comprises the locking element that cooperates with the receiving element during operation of the slide cam system such that the displacement element is locked between two positional changes, wherein the locking element is disposed in a rotationally secure manner on the carrier shaft and is displaceable in a longitudinal direction of the carrier shaft, wherein the locking element is axially guided in a cylinder head cover.

33. The slide cam system of claim 1 wherein the displacement element comprises the receiving element, wherein the carrier shaft comprises the locking element that cooperates with the receiving element during operation of the slide cam system such that the displacement element is locked between two positional changes, wherein the locking element is disposed on the carrier shaft in a rotationally secure manner and is fixed in a longitudinal direction of the carrier shaft.

34. The slide cam system of claim 1 wherein the displacement element is disposed at a rotation angle that is offset relative to the actuator pin.

35. The slide cam system of claim 1 wherein the at least one switching groove of the at least one slotted switching member of the first slide cam element is a first switching groove, wherein the at least one slotted switching member of the first slide cam element includes a second switching groove, wherein the second switching groove is disposed at an axial end of the first slide cam element beside the first switching groove or the second switching groove is disposed between two axial ends of the first slide cam element, wherein the second switching groove extends over an entire periphery of the first slide cam element.

36. The slide cam system of claim 1 wherein the at least one switching groove of the first slide cam element is at least partially Y-shaped or at least partially S-shaped.

37. A motor comprising the slide cam system of claim 1.

38. A slide cam system for an internal combustion engine having a camshaft comprising:

a carrier shaft having a first slide cam element and a second slide cam element that each comprise at least one switching member and a switching groove, wherein the switching groove of the first slide cam element includes a first switching groove that includes an at least partially Y-shaped profile;

an actuator pin, wherein the first and second slide cam elements are displaceable axially relative to the carrier shaft by the actuator pin; and a displacement element disposed parallel with a longitudinal axis of the carrier shaft, wherein the displacement element is axially displaceable in a direction of the longitudinal axis of the carrier shaft, wherein the displacement element comprises:

a first coupling pin that is disposed in a region of the first slide cam element, wherein the switching groove of the first slide cam element further includes a second switching groove configured to receive the first coupling pin that is arranged such that the displacement element is directly displaceable, and a second coupling pin that is disposed in a region of the second slide cam element, wherein the first and second coupling pins cooperate with the switching member of the respective first and second slide cam elements such that as a result of the displacement element a movement initiated by the actuator pin of the first slide cam element is configured to be transmitted to the second slide cam element wherein the second switching groove is at least partially disposed centrally in the at least partially Y-shaped profile of the first switching groove, wherein the second switching groove extends over an entire periphery.

39. The slide cam system of claim 38 wherein the second switching groove is an annular groove that extends over the entire periphery with a constant radius, wherein in the second switching groove the first coupling pin is permanently disposed such that axial displacement of the first slide cam element is configured to be transmitted directly to the displacement element.

40. A slide cam system for an internal combustion engine having a camshaft comprising:

a carrier shaft having a first double slide cam element and a second double slide cam element that control valves of cylinders, wherein the first and second double slide cam elements each comprise:

a slotted switching member having a switching groove, and a cam portion having a stroke cam contour;

an actuator pin, wherein the first and second double slide cam elements are displaceable axially relative to the carrier shaft by the actuator pin; and a displacement element disposed parallel with a longitudinal axis of the carrier shaft, wherein the displacement element is axially displaceable in a direction of the longitudinal axis of the carrier shaft, wherein the displacement element comprises:

a first coupling pin that is disposed in a region of the first double slide cam element, and a second coupling pin that is disposed in a region of the second double slide cam element, wherein the first and second coupling pins cooperate with the slotted switching member of the respective first and second double slide cam elements such that a movement of the first double slide cam element initiated by the actuator pin is configured to be transmitted to the second double slide cam element by the displacement element, and wherein the displacement element comprises a receiving element, wherein the carrier shaft comprises a locking element that cooperates with the receiving element during operation of the slide cam system such that the displacement element is locked between two positional changes.

* * * * *